US007673918B2

(12) United States Patent
Cveykus

(10) Patent No.: US 7,673,918 B2
(45) Date of Patent: Mar. 9, 2010

(54) SELF-OPENING TONG LIFTING DEVICE

(75) Inventor: Gregory A. Cveykus, Johnstown, PA (US)

(73) Assignee: Kenco Corporation, Ligonier, PA (US)

( * ) Notice: Subject to any disclaimer, the term of this patent is extended or adjusted under 35 U.S.C. 154(b) by 825 days.

(21) Appl. No.: 11/372,496

(22) Filed: Mar. 10, 2006

(65) Prior Publication Data

US 2006/0202497 A1 Sep. 14, 2006

Related U.S. Application Data

(60) Provisional application No. 60/661,164, filed on Mar. 11, 2005.

(51) Int. Cl.
*B66C 1/28* (2006.01)

(52) U.S. Cl. ..... 294/118

(58) Field of Classification Search ..... 294/88, 294/118

See application file for complete search history.

(56) References Cited

U.S. PATENT DOCUMENTS 541,842 A * 7/1895 Finley ..... 294/118
832,727 A * 10/1906 Hampton ..... 294/118
2,743,954 A * 5/1956 Ostlund ..... 294/113
3,727,968 A * 4/1973 Tsuchihashi et al. ..... 294/88
3,759,564 A * 9/1973 Seaberg ..... 294/88
6,012,752 A 1/2000 Douglas
6,331,025 B1 12/2001 Douglas

* cited by examiner

*Primary Examiner*—Paul T Chin
(74) *Attorney, Agent, or Firm*—Alan G. Towner, Esq.; Pietragallo Gordon Alfano Bosick & Raspanti, LLP

(57) ABSTRACT

A tong device for lifting various types and sizes of objects is disclosed. The tong lifting device includes tongs pivotally mounted on a slide rod which is extendable from a lift sleeve. Each tong has an attachment engaging end and an arm extending away from the attachment engaging end. Linkages are pivotally attached to the arms of the tongs, and are pivotally attached to a sliding lobe which travels along the length of the lift sleeve. The design of the lifting device provides a self-opening mode of operation and can be reconfigured in the field for optimum performance.

20 Claims, 25 Drawing Sheets

SELF-OPENING TONG LIFTING DEVICE

CROSS-REFERENCE TO RELATED APPLICATION

This application claims the benefit of U.S. Provisional Patent Application Ser. No. 60/661,164 filed Mar. 11, 2005, which is incorporated herein by reference.

FIELD OF THE INVENTION

The present invention provides a device for lifting a variety of objects, and more particularly relates to a self-opening scissor tong lifting device.

BACKGROUND INFORMATION

Various types of lifting devices are used for lifting objects such as logs, pipes, debris, concrete highway barriers, rocks and the like. For example, U.S. Pat. No. 6,012,752 to Douglas describes a concrete pipe lifting apparatus with a lockable and releasable scissor grip structure. U.S. Pat. No. 6,331,025 to Douglas describes a barrier lifter apparatus having a scissor structure with L-shaped clamping elements.

SUMMARY OF THE INVENTION

The present invention provides a tong device for lifting various types and sizes of objects. The tong lifting device includes tongs pivotally mounted on a slide rod which is extendable from a lift sleeve. Each tong has an attachment engaging end and an arm extending away from the attachment engaging end. Linkages are pivotally attached to the arms of the tongs, and are pivotally attached to a sliding lobe which travels along the length of the lift sleeve. The design of the lifting device provides a self-opening mode of operation and can be reconfigured in the field for optimum performance.

An aspect of the present invention is to provide a tong lifting device comprising: a lift sleeve; a slide rod extendable from the lift sleeve; at least two tongs pivotally mounted on the slide rod, each tong having an attachment end structured and arranged for mounting an attachment thereto and an arm extending away from the attachment end; a sliding lobe assembly slidably mounted on the lift sleeve; and at least two linkages pivotally connected to the sliding lobe assembly, each linkage pivotally connected to the arm of one of the tongs.

Another aspect of the present invention is to provide an assembly including the above-noted tong lifting device and an attachment mounted thereon.

A further aspect of the present invention is to provide attachments for mounting on the above-noted tong lifting device.

These and other aspects of the present invention will be more apparent from the following description.

DETAILED DESCRIPTION

Figure 1:
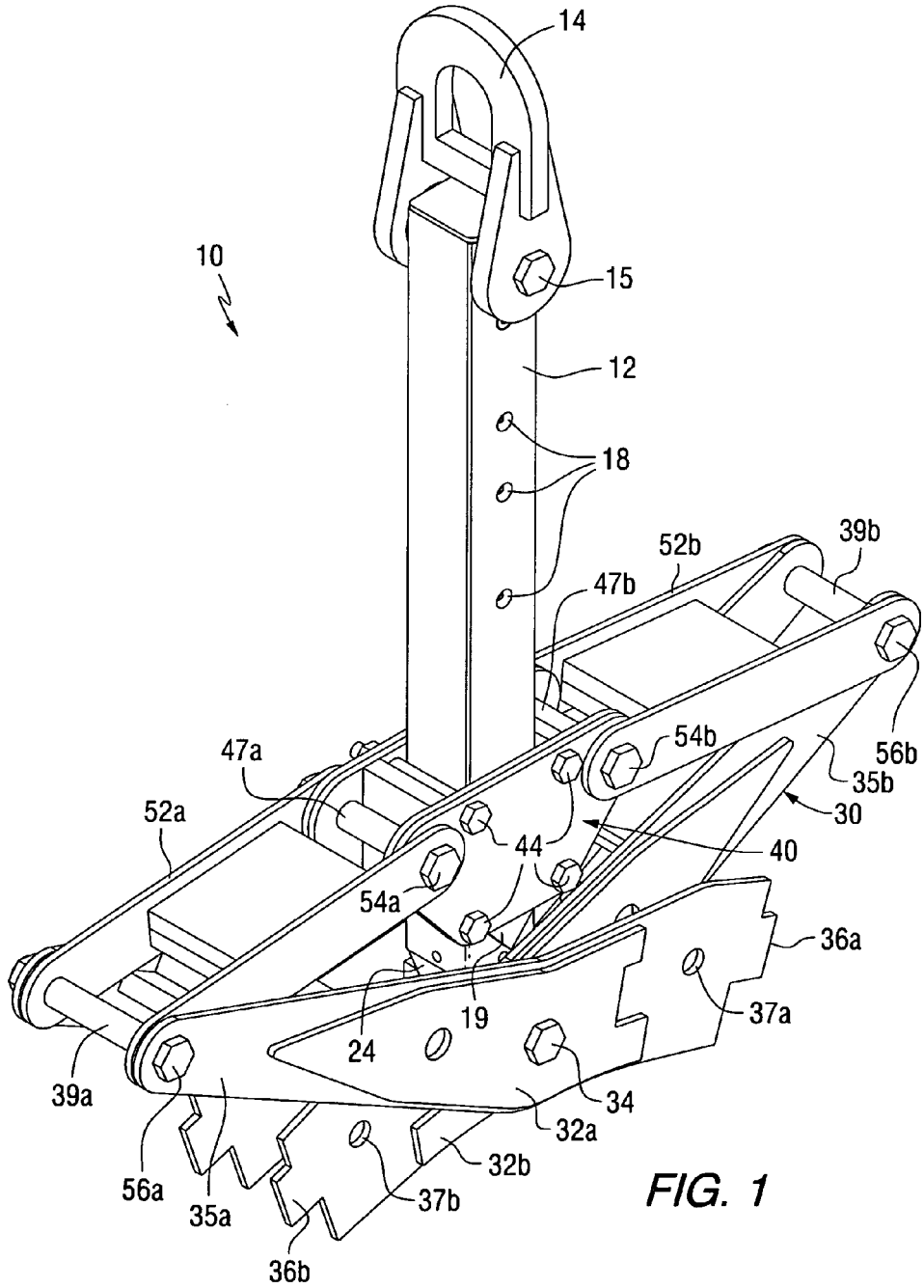
FIG. 1 is an isometric view of a tong lifting assembly in accordance with an embodiment of the present invention.
Figure 3:
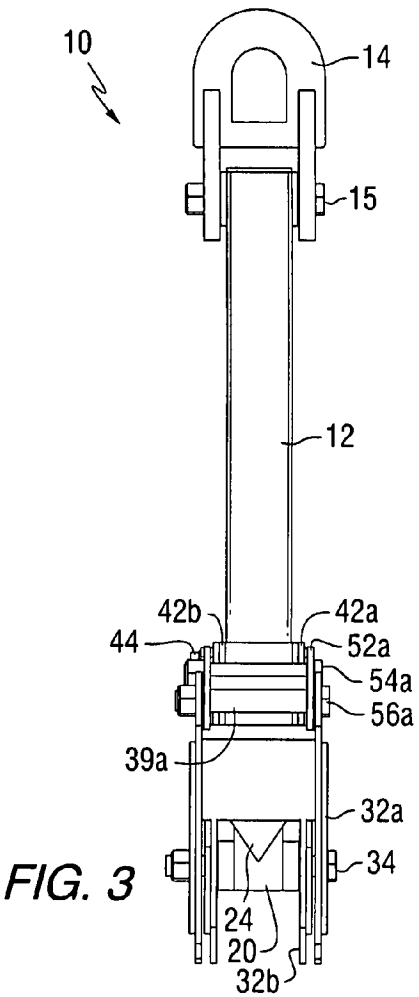
FIG. 3 is a side view of the tong lifting assembly of FIG. 1.
Figure 2:
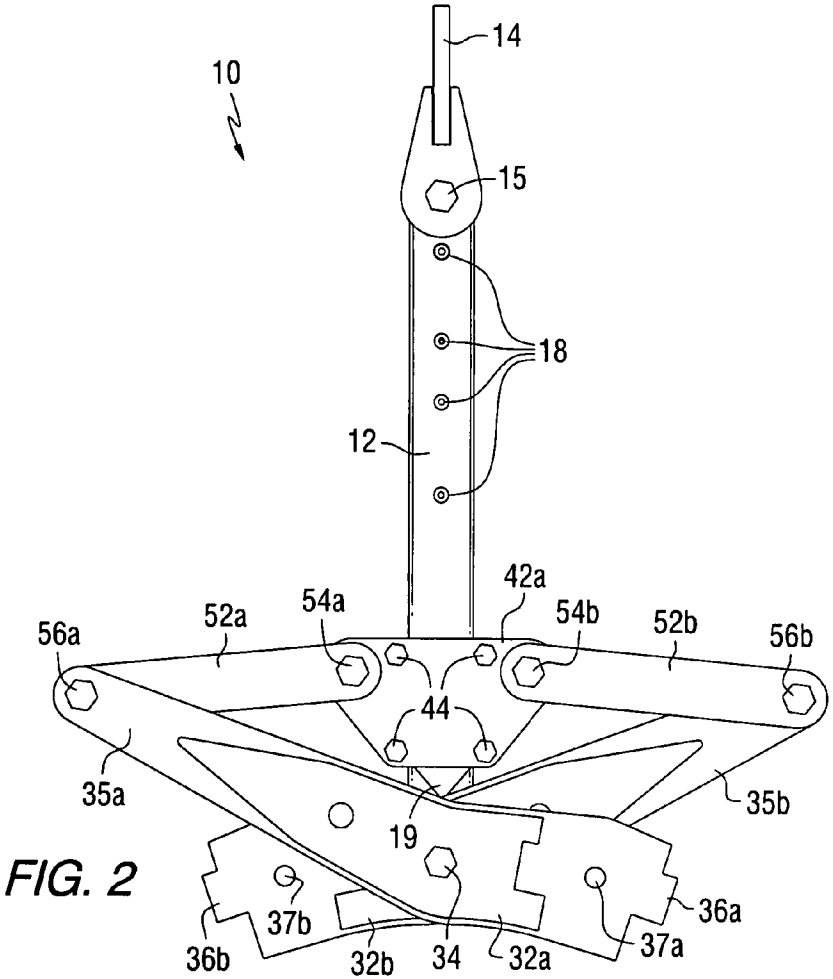
FIG. 2 is a front view of the tong lifting assembly of FIG. 1.
Figure 4:
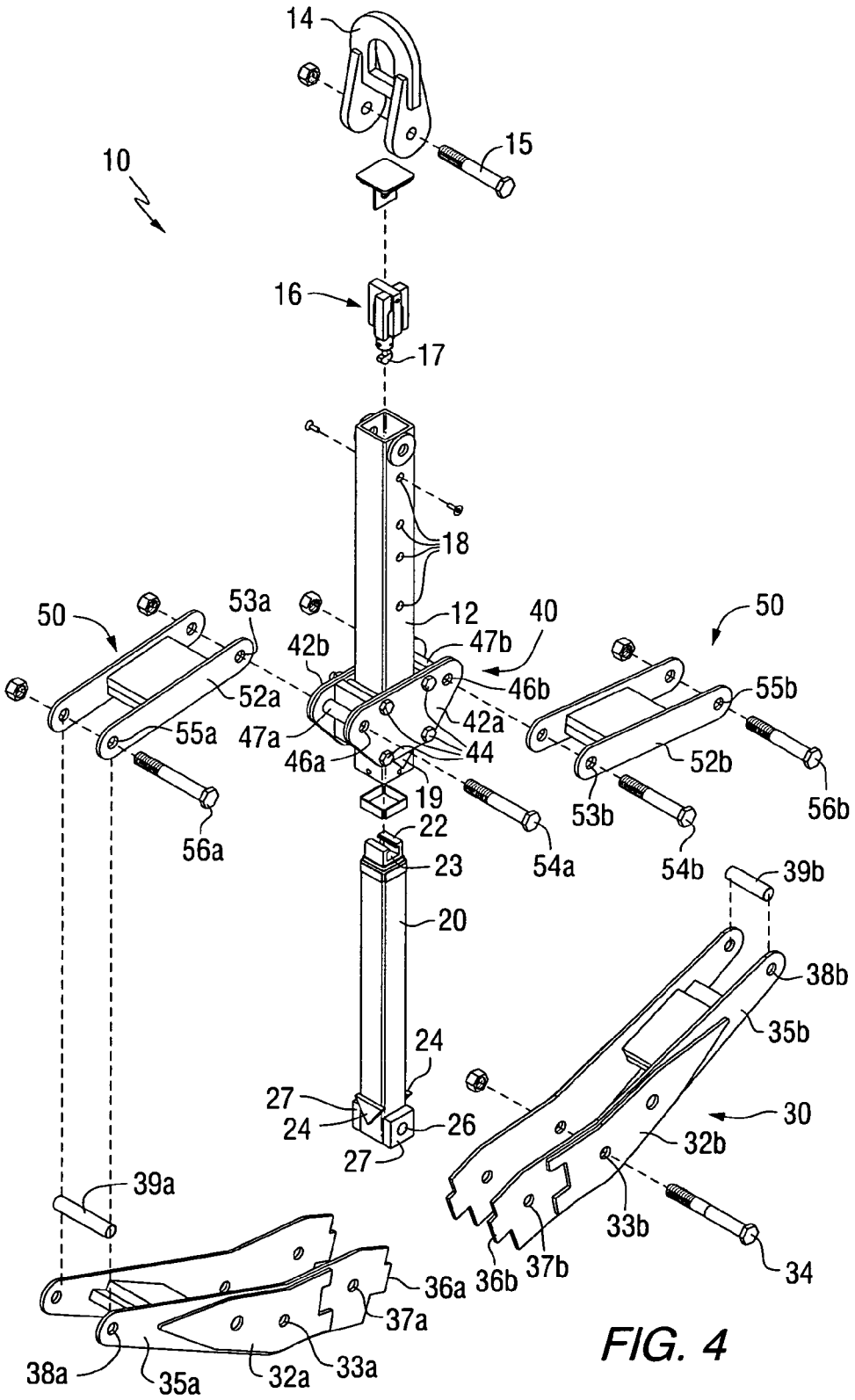
FIG. 4 is an exploded isometric view illustrating the components of the tong lifting assembly of FIG. 1.

FIGS. 1-4 illustrate a tong lifting device 10 in accordance with an embodiment of the present invention. The device 10 includes a lift sleeve 12 with a hook 14 mounted at the upper end thereof by a bolt 15. During operation, the device 10 is suspended by the hook 14. A latch assembly 16 having a retractable and rotatable latch 17 is mounted inside the lift sleeve 12 by means of mounting holes 18 located at various positions along the length of the lift sleeve 12. Lift blocks 19 are provided near the lower end of the lift sleeve 12 on opposing sides thereof. As more fully described below, the lift blocks 19 contact a sliding lobe of the tong lifting device 10 during its operation.

A slide rod 20 is slidably received within the lift sleeve 12 and can be extended or retracted in relation to the lift sleeve 12. A keeper 22 having a channel 23 is mounted at the top end of the slide rod 20. As more fully described below, the channel 23 has a generally T-shaped cross section for receiving and retaining the latch 17 during operation of the device 10. Stop members 24 are provided near the bottom end of the slide rod 20 in order to contact the bottom end of the lift sleeve 12 during operation of the device 10, as more fully described below. As shown most clearly in FIG. 4, a tong pivot hole 26 extends transversely through the bottom of the slide rod 20. The tong pivot hole 26 extends through square pivot blocks 27 which are raised from the side surfaces of the slide rod 20.

The tong lifting device 10 includes a tong assembly 30 comprising a pair of tongs 32*a* and 32*b*. Pivot holes 33*a* and 33*b* are provided through the tongs 32*a* and 32*b*, respectively. In the embodiment shown in FIGS. 1-4, a central tong pivot pin 34 is inserted through the tong pivot holes 33*a* and 33*b*, and through the tong pivot hole 26 of the slide rod 20 for pivotal attachment of the tongs 32*a* and 32*b* on the slide rod 20. Alternatively, an additional center link mounted on the square pivot blocks 27 of the slide rod 20 may be used instead of the central tong pivot pin 34, as discussed in more detail below.

The tong 32*a* has an attachment end 36*a* and an attachment mounting hole 37*a* at one end thereof, and a linkage pin hole 38*a* and a linkage sleeve 39*a* at the other end thereof. Similarly, the tong 32*b* has an attachment end 36*b* and an attachment mounting hole 37*b* at one end thereof, and a linkage pin hole 38*b* and a linkage sleeve 39*b* at the other end thereof. The attachment end 36*a* and 36*b* of each tong 32*a* and 32*b* includes a tab or key projection, as well as a recess formed in a raised portion of the tong which is spaced from the tab. As more fully described below, this tab and recess arrangement helps secure various attachments to the tongs 32*a* and 32*b*.

The tong lifting device 10 also includes a sliding lobe assembly 40 comprising opposing lobe plates 42*a* and 42*b* which are spaced apart and secured to each other by bolts 44. The sliding lobe assembly 40 is movable along the length of the lift sleeve 12, with the lift blocks 19 at the bottom of the lift sleeve 12 engaging the lobe assembly 40 and preventing it from sliding off the bottom end of the lift sleeve 12. Linkage pivot holes 46*a* and 46*b* are provided through the lobe plates 42*a* and 42*b* of the lobe assembly 40. Sleeves 47*a* and 47*b* extend between the lobe plates 42*a* and 42*b* at the locations of the linkage pivot holes 46*a* and 46*b*, respectively.

The tong lifting device 10 also includes a linkage assembly 50 comprising linkages 52*a* and 52*b*. The linkage 52*a* includes a lobe pivot hole 53*a* receiving a pivot pin 54*a* at one end thereof, and a tong pivot hole 55*a* receiving a pivot pin 56*a* at the other end thereof. The linkage sleeve 39*a* is aligned with the tong pivot hole 55*a*. Similarly, the linkage 52*b* includes a lobe pivot hole 53*b* receiving a pivot pin 54*b* at one end thereof, and a tong pivot hole 55*b* receiving a pivot pin 56*b* at the other end thereof. The linkage sleeve 39*b* is aligned with the tong pivot hole 55*b*. Each linkage 52*a* and 52*b* is thus pivotally mounted on the sliding lobe assembly 40 and pivotally mounted on the end of a tong arm 35*a* and 35*b*, respectively.

Figure 5:
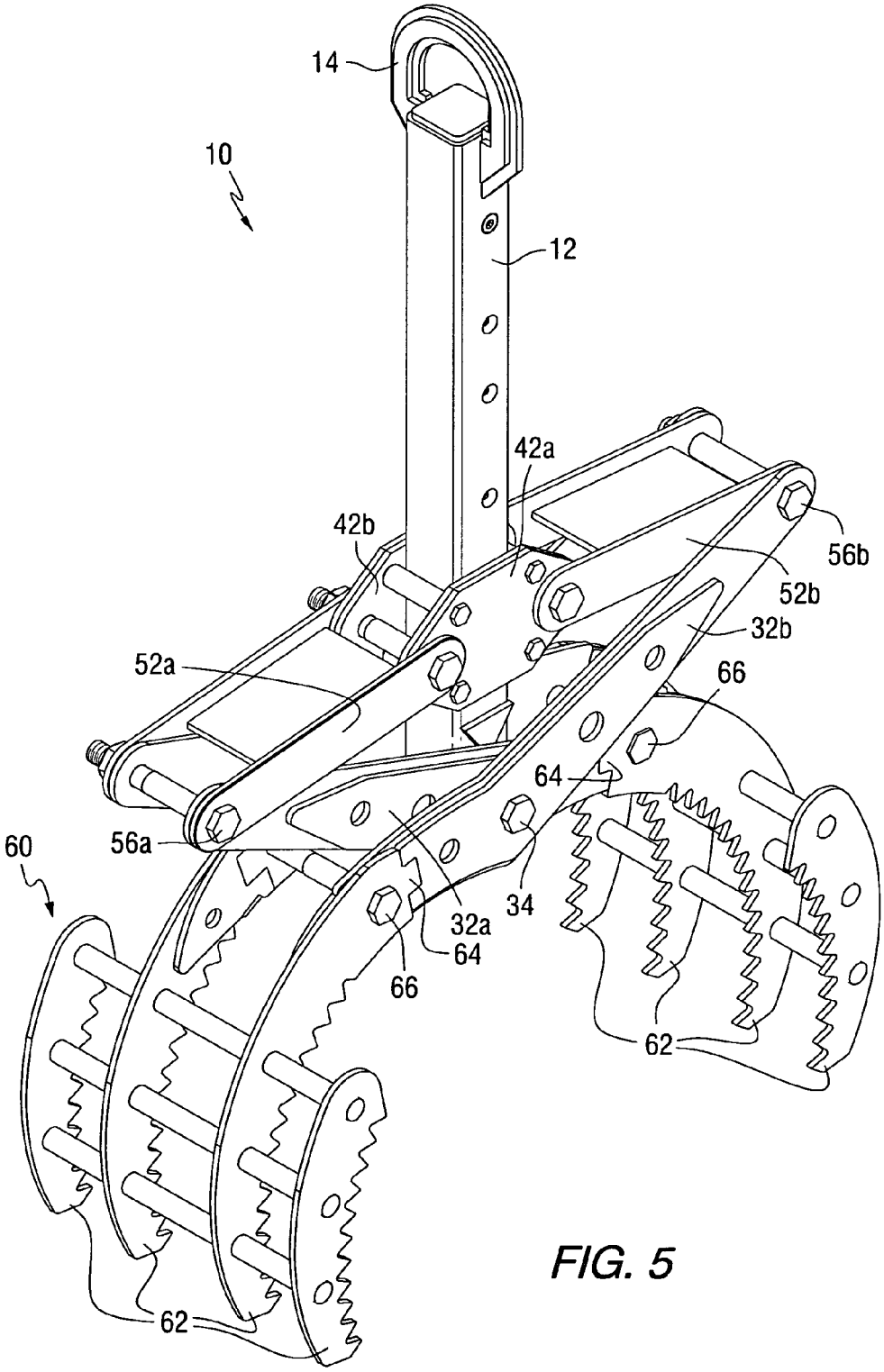
FIG. 5 is an isometric view of a tong lifting assembly similar to the device shown in FIGS. 1-4 with a load engaging attachment having toothed claws mounted on the assembly in accordance with an embodiment of the present invention.
Figure 6:
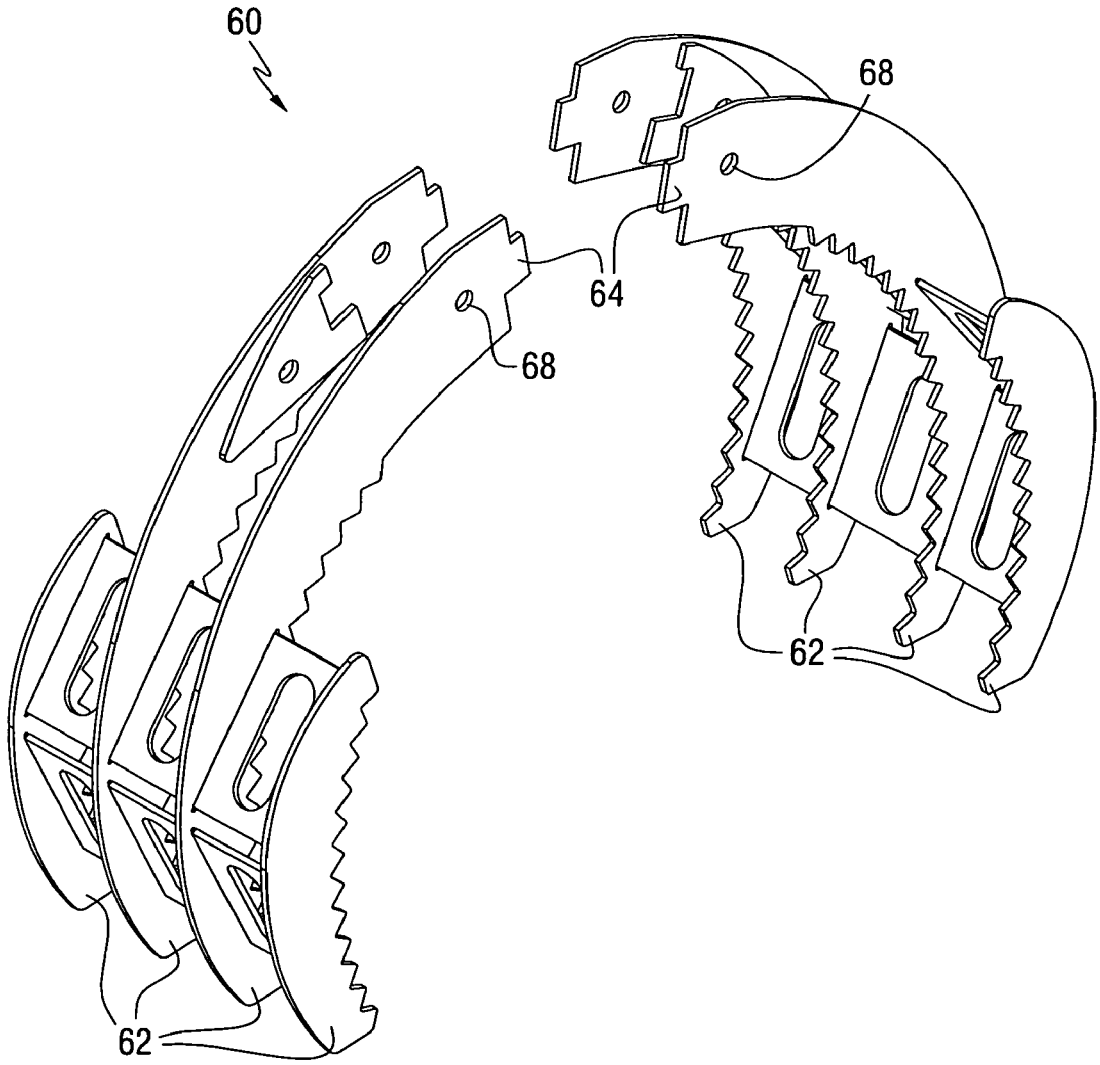
FIG. 6 is an isometric view of the toothed claw attachment of FIG. 5.

FIG. 5 is an isometric view of a tong lifting assembly 10 similar to that shown in FIGS. 1-4, with a toothed claw attachment 60 mounted thereon. FIG. 6 is an isometric view of the toothed claw attachment 60 without the tong lifting assembly. The attachment 60 includes multiple toothed claws 62 which are configured to lift various objects such as logs, debris and the like. The attachment 60 includes mounting ends 64 which have a tab as well as a recess formed in a raised portion of the mounting end spaced from the tab. This arrangement is complimentary to the tab and recess arrangement provided at the attachment ends 36*a* and 36*b* of the tongs 32*a* and 32*b*. A mounting bolt 66 is inserted through mounting holes 68 which extend through the mounting ends 64 of the attachment 60. The mounting bolts 66 are also inserted through the mounting holes 37*a* and 37*b* of the tongs 32*a* and 32*b* in order to secure the toothed claw attachment 60 to the tong lifting device 10.

The various components of the tong lifting assembly 10, and the attachments mounted thereon, are made from standard materials such as steel or any other suitable materials known to those skilled in the art.

Figure 7:
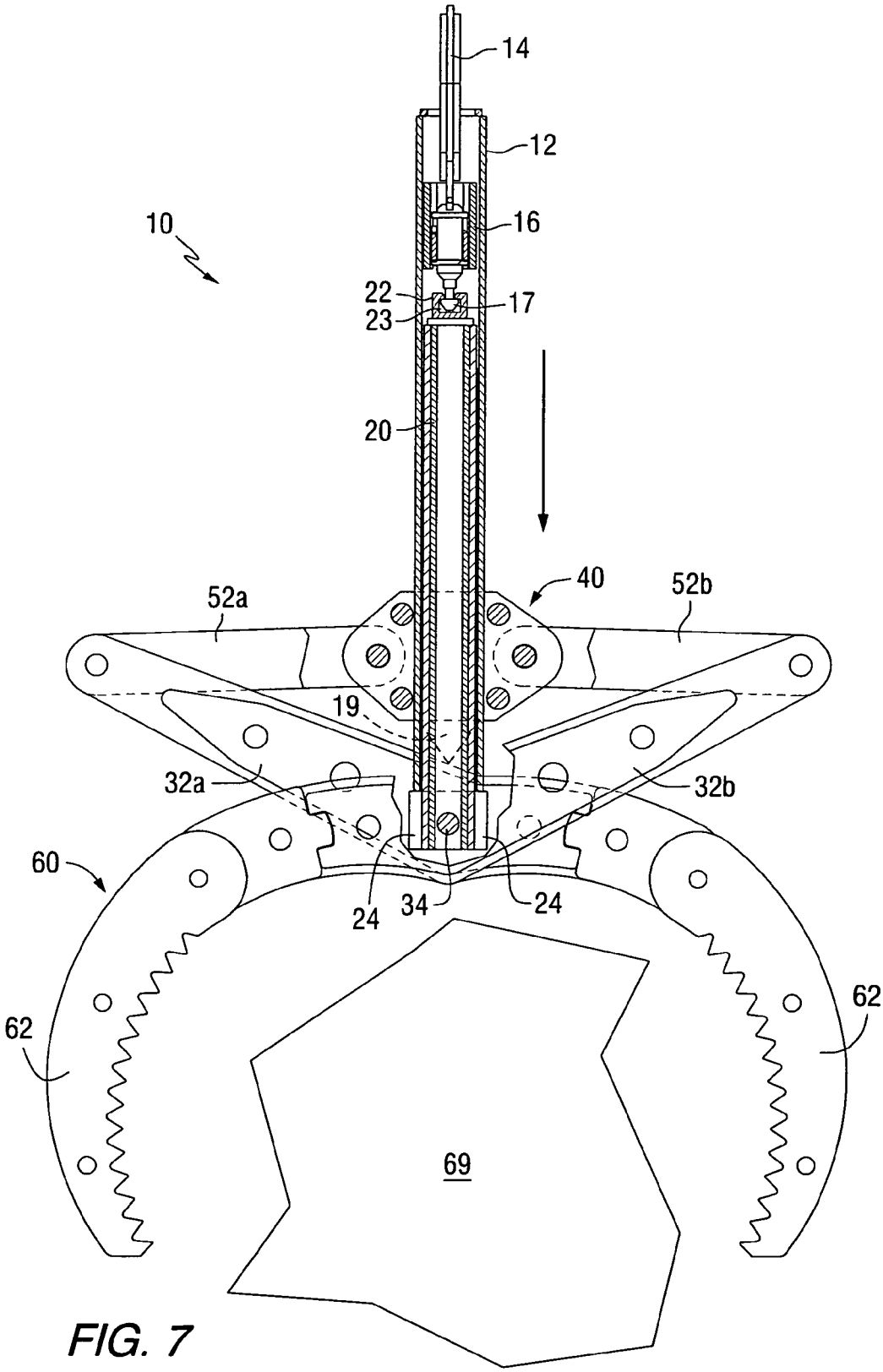
FIGS. 7-10 are side views illustrating operation of the tong lifting assembly and attachment of FIG. 5.

FIGS. 7-10 illustrate operation of a tong lifting assembly 10 and toothed claw attachment 60 similar to that shown in FIG. 5. In FIG. 7, the toothed claws 62 of the attachment 60 are in an open position while the device 10 is being lowered toward an object to be lifted 69. During this stage, the outer lift sleeve 12 and the inner slide rod 20 travel downward together, and the latch 17 is secured in the channel 23 of the keeper 22.

Figure 8:
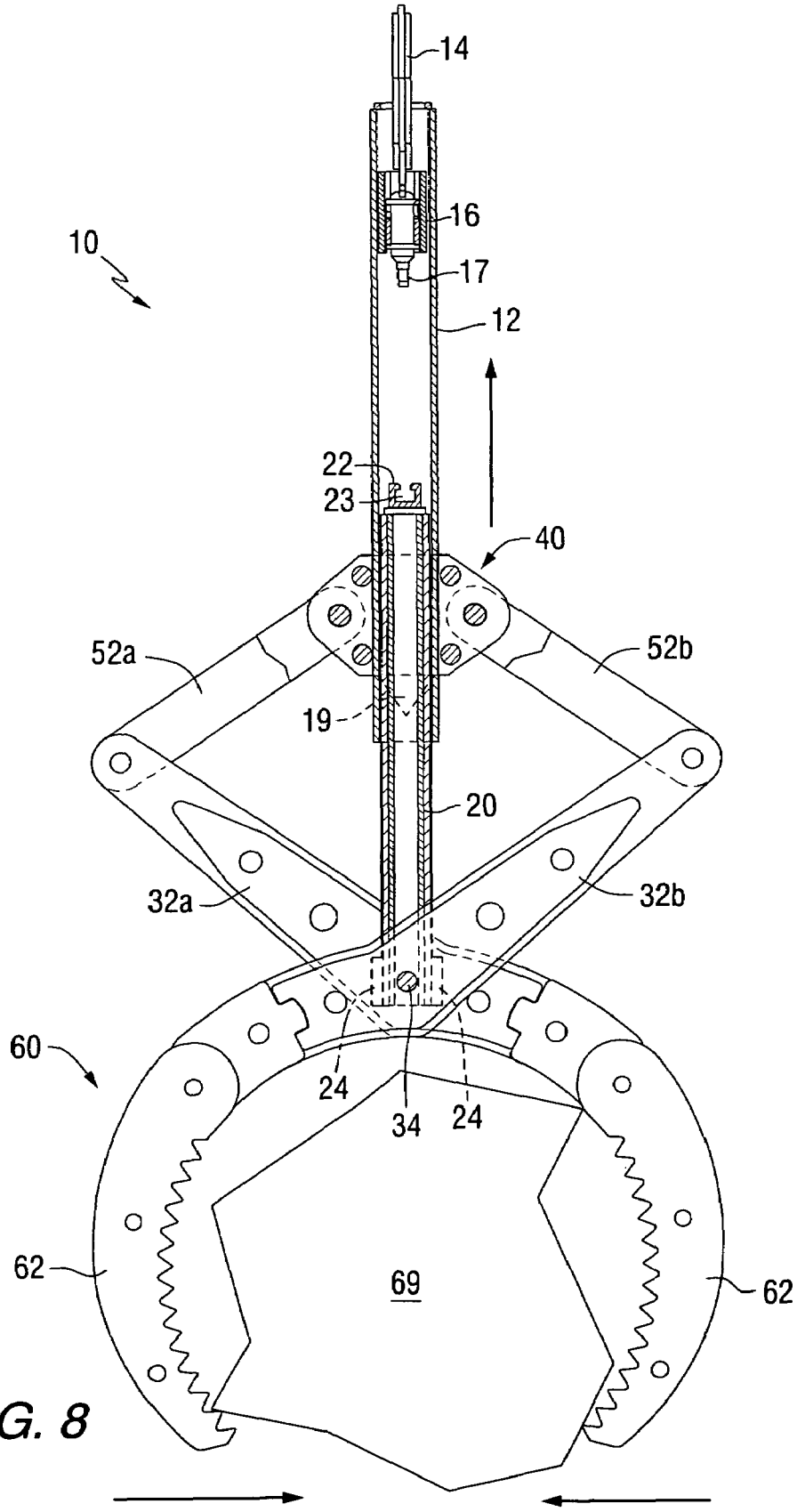

In FIG. 8, the latch 17 has been released from the keeper 22, thereby allowing relative movement between the lift sleeve 12 and the slide rod 20 as the hook 14 is pulled upward. The upward movement of the lift sleeve 12 pulls the sliding lobe assembly 40 upward due to contact with the lift blocks 19 at the bottom of the lift sleeve 12. The upward movement of the sliding lobe assembly 40 draws the toothed claws 62 of the attachment 60 together by means of the linkages 52*a* and 52*b*, and the pivotal mounting of the tongs 32*a* and 32*b* on the central pivot pin 34 at the bottom of the slide rod 20.

Figure 9:
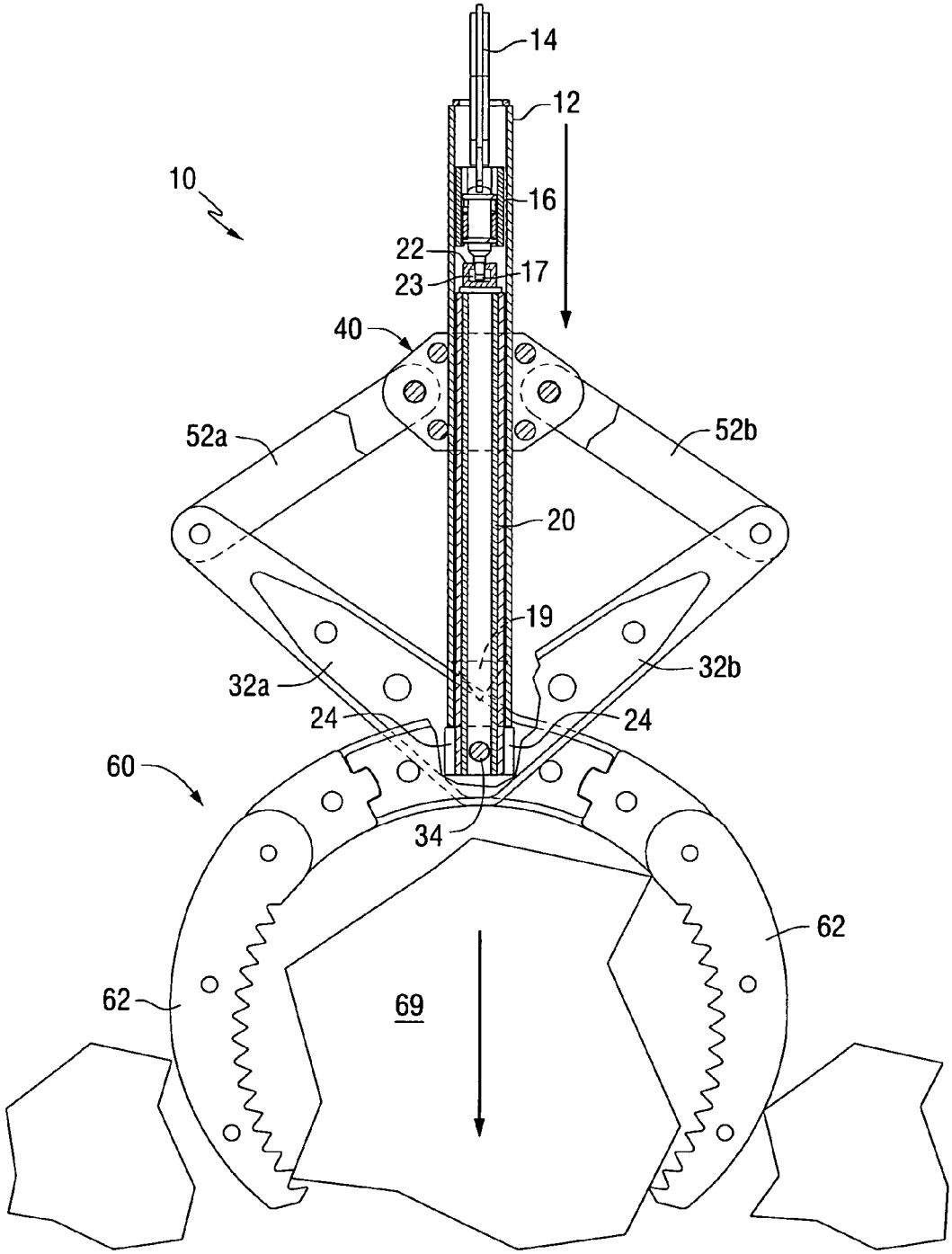
Figure 10:
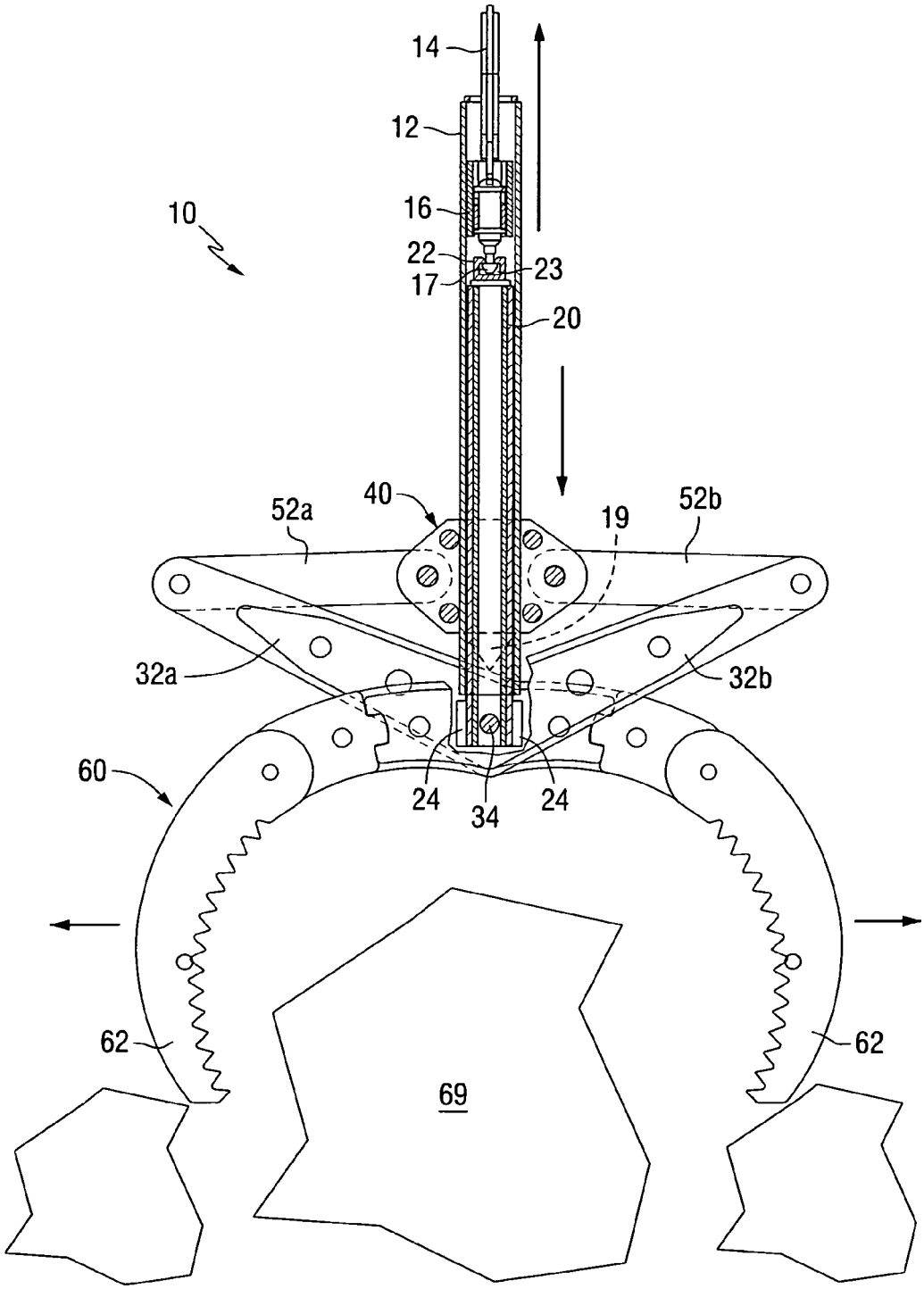

In FIG. 9, the object 69 is lowered to a resting place and the lift sleeve 12 moves downward to receive the slide rod 20 as the hook 14 is lowered. This relative downward movement of the lift sleeve 12 in relation to the slide rod 20 causes the latch 17 to contact the keeper 22 at the top of the slide rod 20. After contact between the latch 17 and keeper 22 is made, further downward movement of the lift sleeve 12 causes the latch 17 to retract toward the latch assembly 16, which causes a 45 degree rotation of the latch 17. Subsequent upward movement of the lift sleeve 12 and latch assembly 16 as shown in FIG. 10 causes another 45 degree rotation of the latch 17 to the position shown in FIG. 10 in which the latch 17 is secured within the channel 23 of the keeper 22. The latch assembly 16 thus produces 90° of rotation with each up and down cycle, to thereby rotate the latch 17 alternatively between engaging and disengaging positions with respect to the keeper 22.

As shown in FIG. 10, with the latch 17 secured in the keeper 22, upward movement of the lift sleeve 12 and slide rod 20 results in lowering of the sliding lobe assembly due to the weight of the components, and opening of the toothed claw attachment 60 as the tongs 32*a* and 32*b* pivot around the center tong pivot pin 34.

When tension is taken off the lift hook 14, the lift sleeve 12 is allowed to slide down through the slide lobe 40 until the latch 17 engages the keeper 22 on the slide rod 20. When tension is reapplied through the hook 14, the lift sleeve 12 and slide rod 20 are coupled together, but the upward tension no longer produces a gripping force on the object 69.

Figure 11:
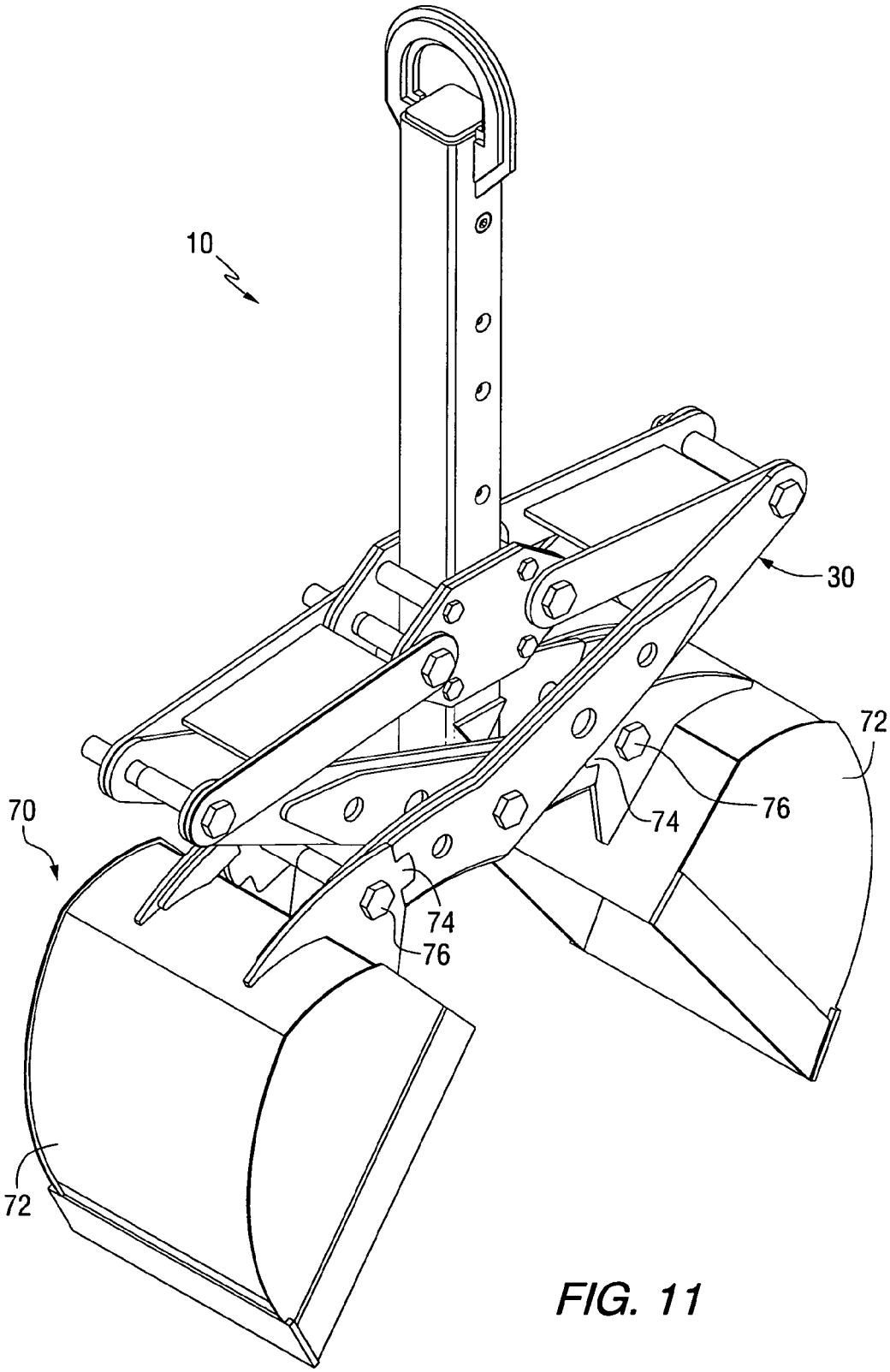
FIG. 11 is an isometric view of a tong lifting assembly and a bucket attachment in accordance with another embodiment of the present invention.
Figure 12:
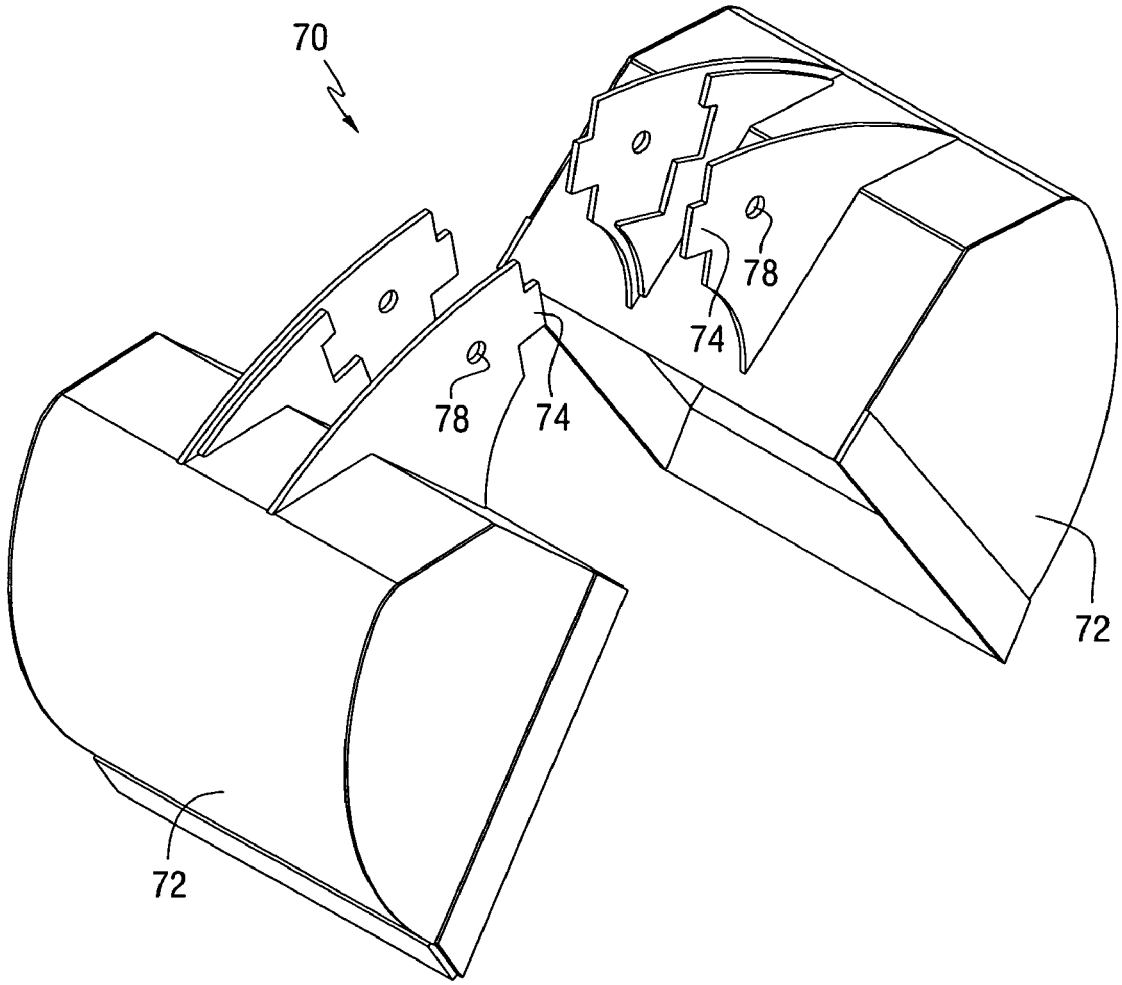
FIG. 12 is an isometric view of the bucket attachment of FIG. 11.

FIGS. 11 and 12 illustrate a tong lifting assembly 10 and a bucket attachment 70 in accordance with another embodiment of the present invention. The bucket attachment 70 includes two opposing buckets 72 mounted by tabbed mounting ends 74 on the tong assembly 30. Mounting bolts 76 are inserted through mounting holes 78 near the mounting ends 74. The mounting bolts 76 also extend through the tong mounting holes 37*a* and 37*b* to secure the bucket 72 to the tongs 32*a* and 32*b*.

Figure 13:
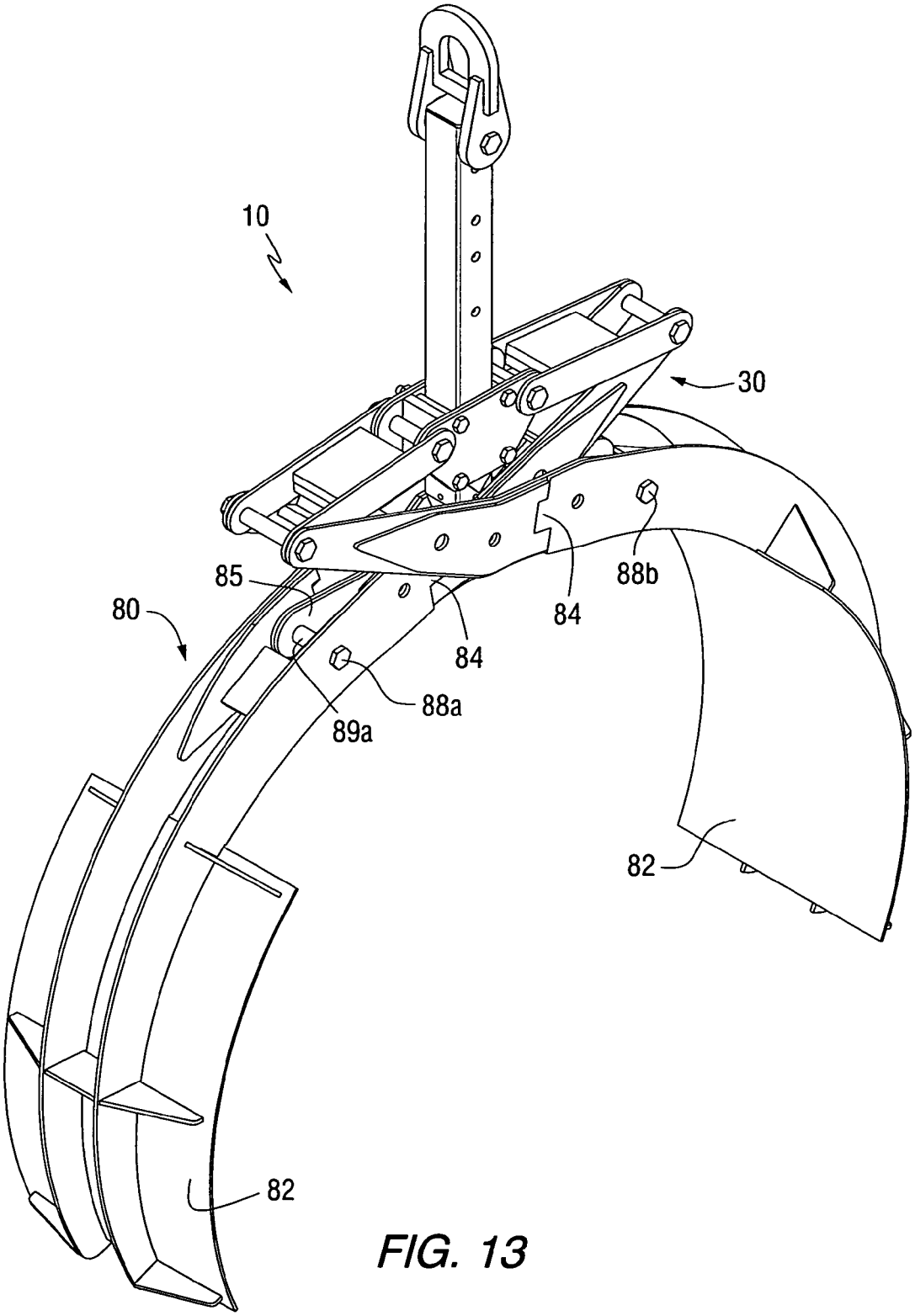
FIG. 13 is an isometric view of a tong lifting assembly and a large pipe lifting attachment in accordance with a further embodiment of the present invention.
Figure 14:
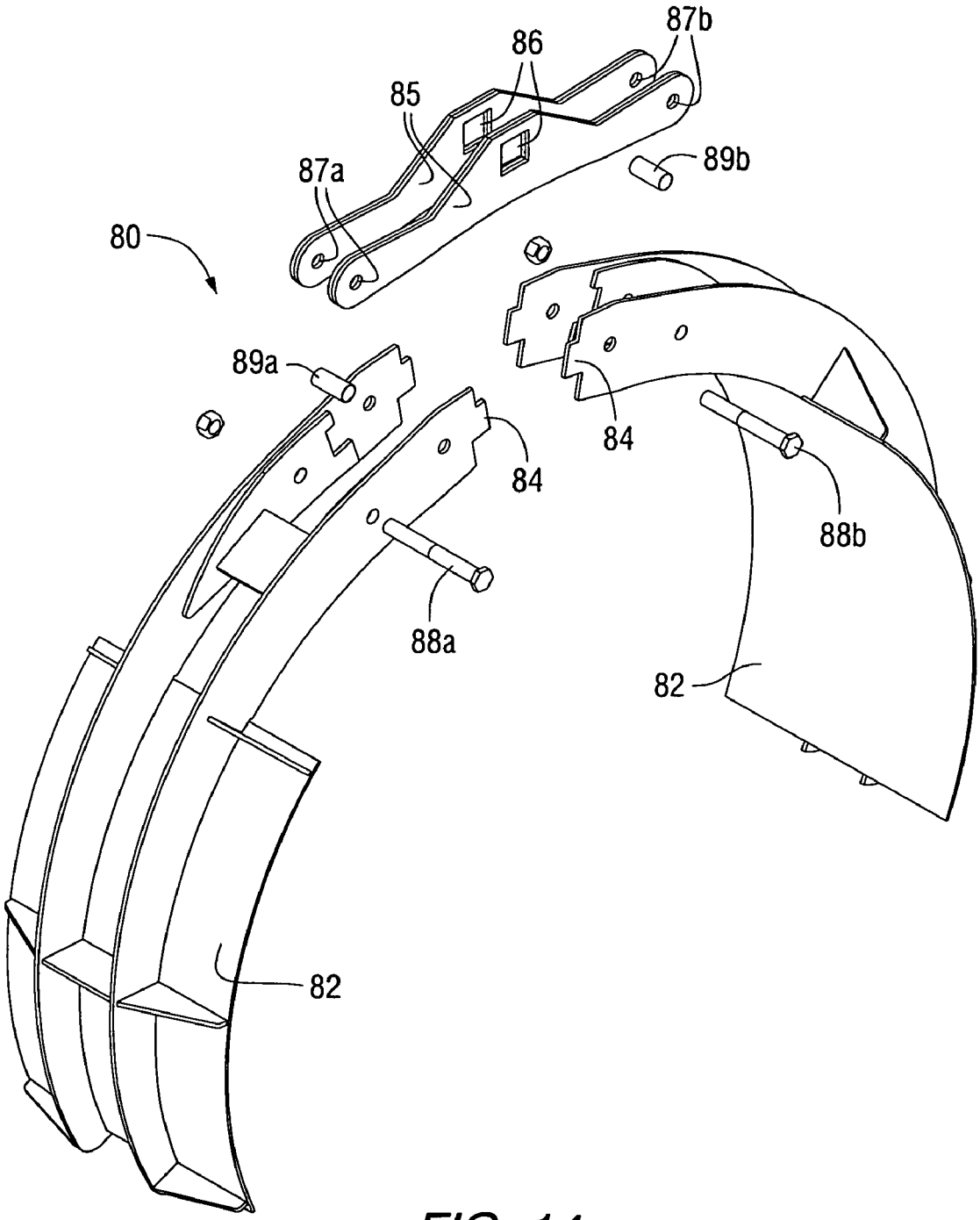
FIG. 14 is an isometric view of the pipe lifting attachment of FIG. 13.

FIGS. 13 and 14 illustrate a tong lifting assembly 10 and a relatively large pipe lifting attachment 80 in accordance with a further embodiment of the present invention. The large pipe lifting attachment 80 includes curved clamps 82 and tabbed mounting ends 84. In this embodiment, a center link 85 is used in place of the center tong pivot pin 34 of the previous embodiments. The center link 85 includes square openings 86 which receive the square projections 27 at the bottom of the slide rod 20, which are shown most clearly in FIG. 4. The center link 85 includes tong pivot holes 87*a* and 87*b*. A sleeve 89*a* is aligned with the pivot hole 87*a*, while a sleeve 89*b* is aligned with the tong pivot holes 87*b*. Tong pivot pins 88*a* and 88*b* extend through the tong pivot holes 87*a* and 87*b*, respectively, and also extend through the attachment mounting holes 37*a* and 37*b* of the tongs 32*a* and 32*b*. The use of the center link 85 allows a larger gripping ratio with a smaller travel distance for the clamps 82.

Figure 15:
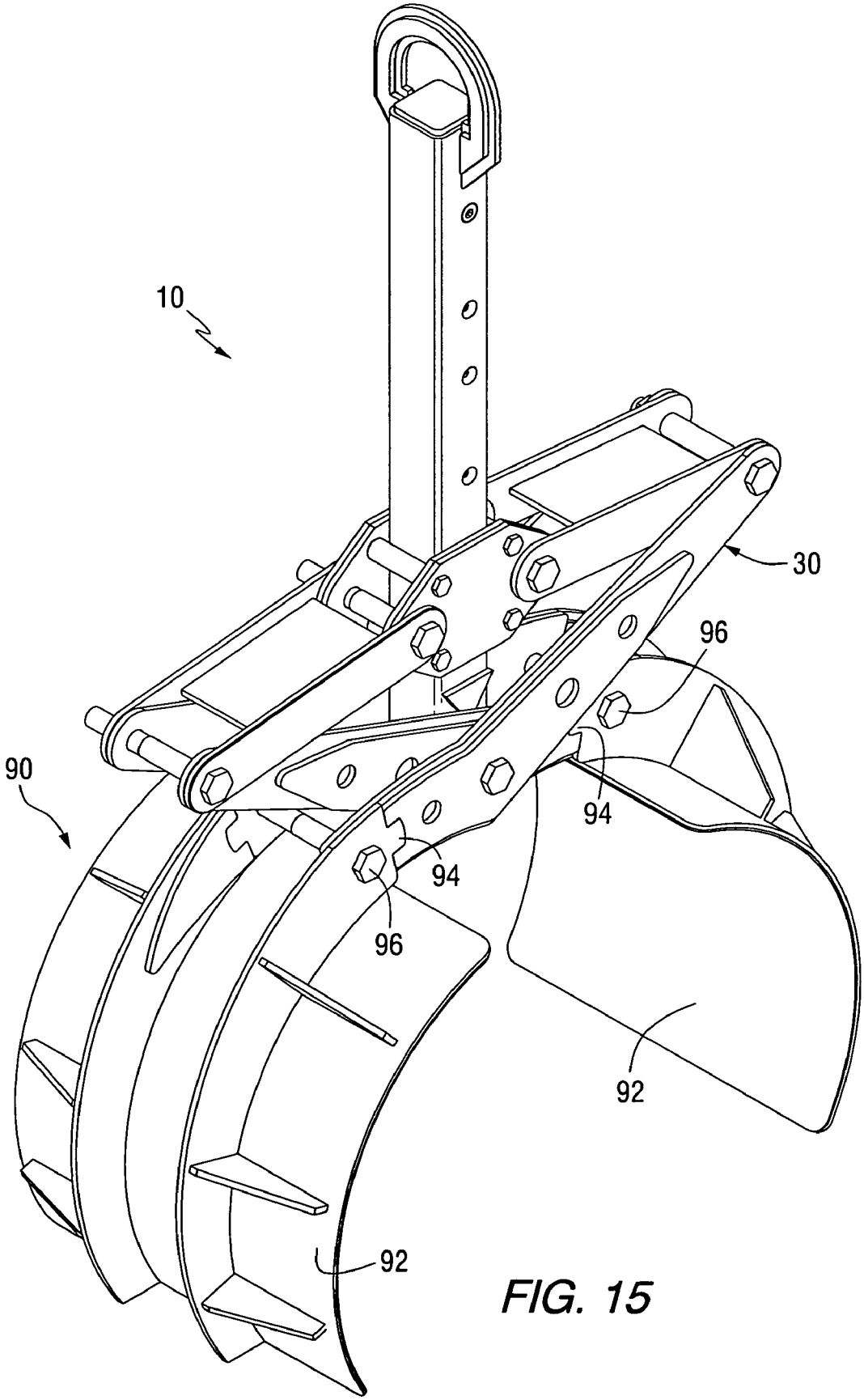
FIG. 15 is an isometric view of a tong lifting assembly and a smaller pipe lifting attachment in accordance with another embodiment of the present invention.
Figure 16:
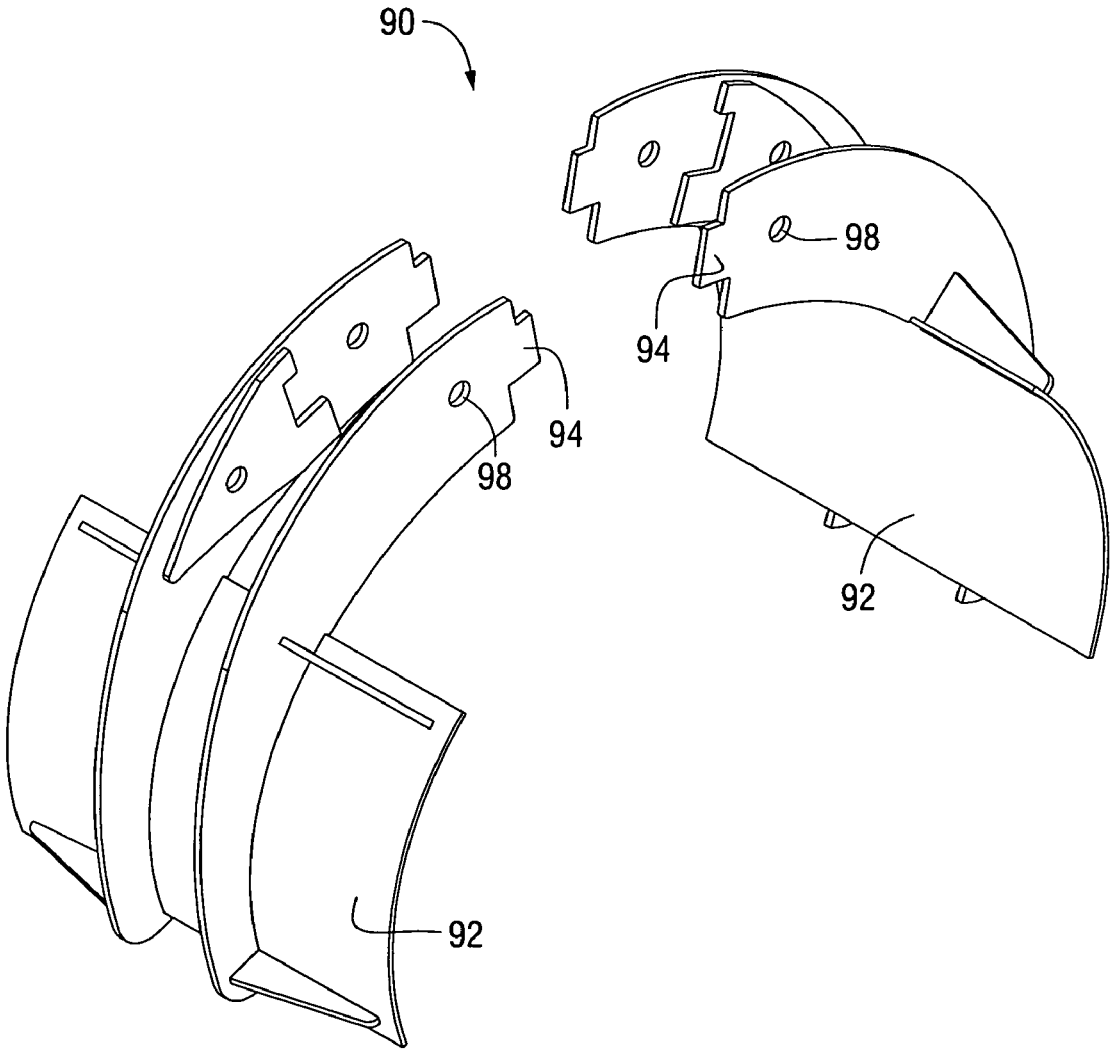
FIG. 16 is an isometric view of the pipe lifting attachment of FIG. 15.

FIGS. 15 and 16 illustrate a tong lifting assembly 10 and a relatively small pipe lifting attachment 90 in accordance with another embodiment of the present invention. The small pipe lifting attachment 90 includes curved clamps 92 and tabbed mounting ends 94. Mounting bolts 96 are inserted through holes 98 near the mounting ends 94. The mounting bolts 96 also extend through the mounting holes 37*a* and 37*b* of the tongs 32*a* and 32*b*.

Figure 17:
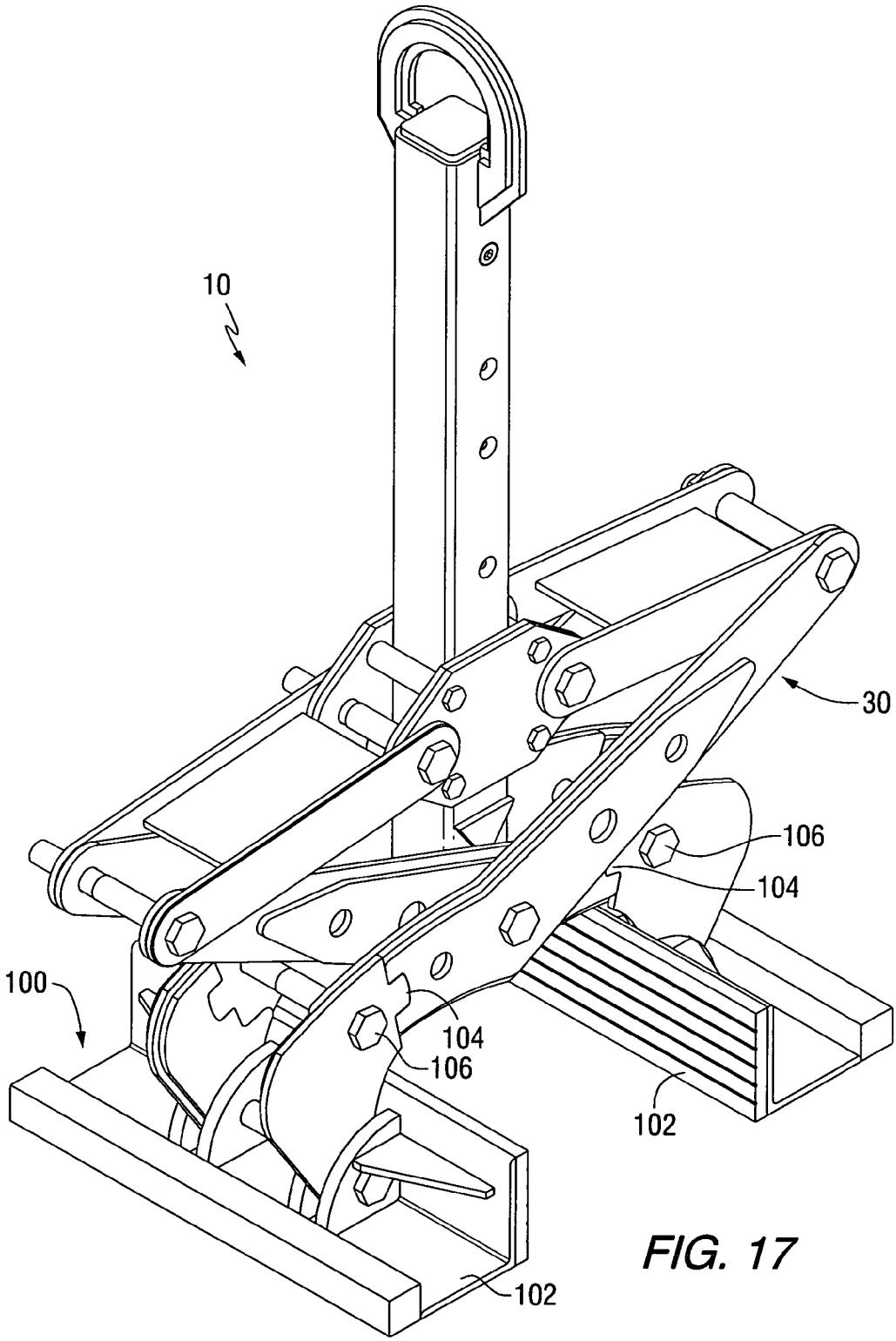
FIG. 17 is an isometric view of a tong lifting assembly and a clamp attachment in accordance with a further embodiment of the present invention.

FIG. 17 illustrates a tong lifting assembly 10 and a clamp attachment 100 in accordance with a further embodiment of the present invention. The clamp attachment 100 includes clamps 102 and tabbed mounting ends 104. Mounting bolts 106 extend through holes near the mounting ends 104. The mounting bolts 106 also extend through the mounting holes 37*a* and 37*b* of the tongs 32*a* and 32*b*.

Figure 18:
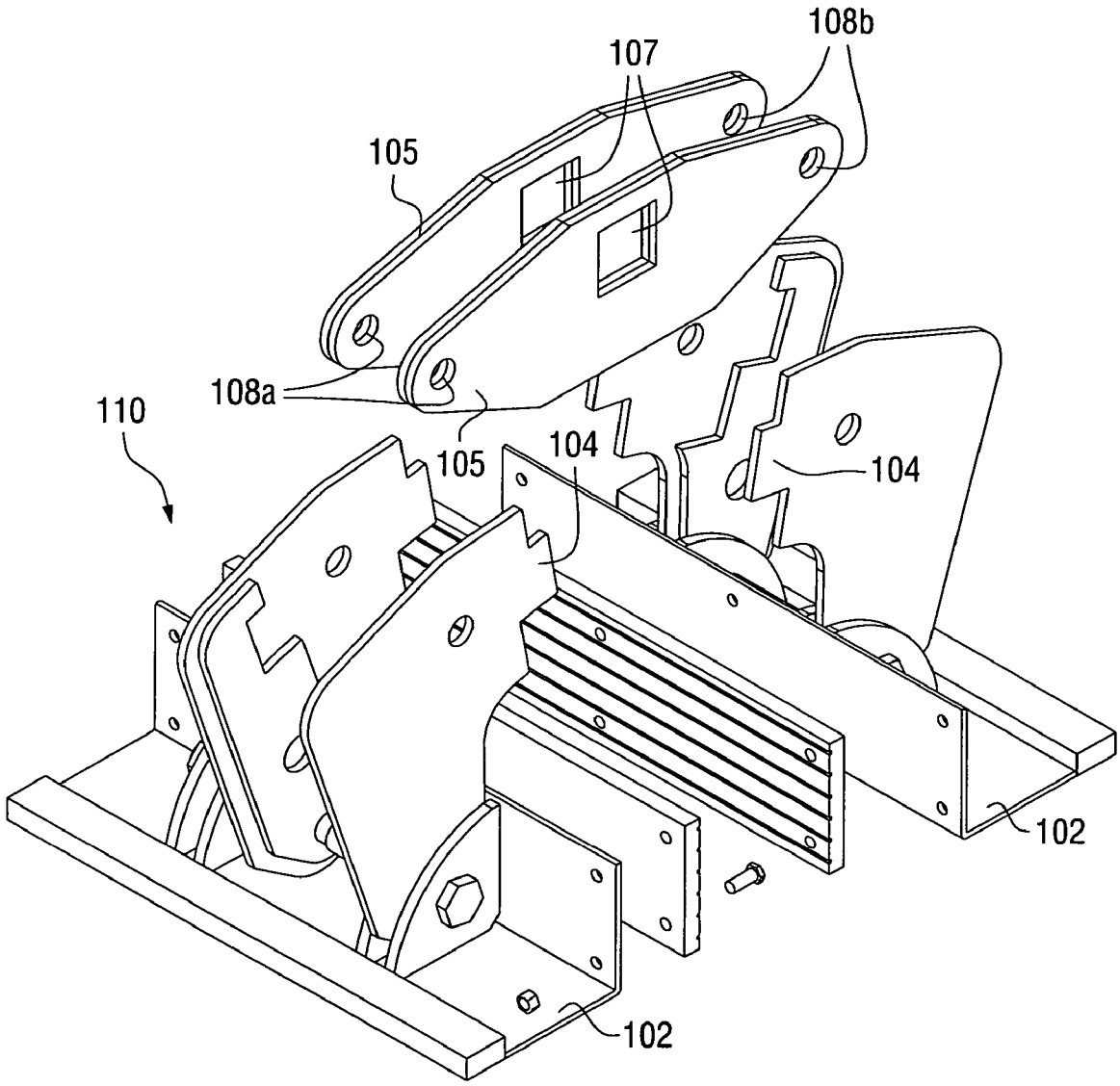
FIG. 18 is an isometric view of a clamp attachment similar to that shown in FIG. 17 with the addition of a center linkage which separates the pivot points for the tong arms.

FIG. 18 illustrates a clamp attachment 110 similar to that shown in 17, except the central tong pivot pin 34 is replaced with a center link 105. Square openings 107 in the center link 105 receive the square projections 27 at the bottom of the slide rod 20. Tong pivot holes 108*a* and 108*b* are provided at opposite ends of the center link 105 for attachment to the mounting holes 37*a* and 37*b* of the tongs 32*a* and 32*b*.

Figure 19:
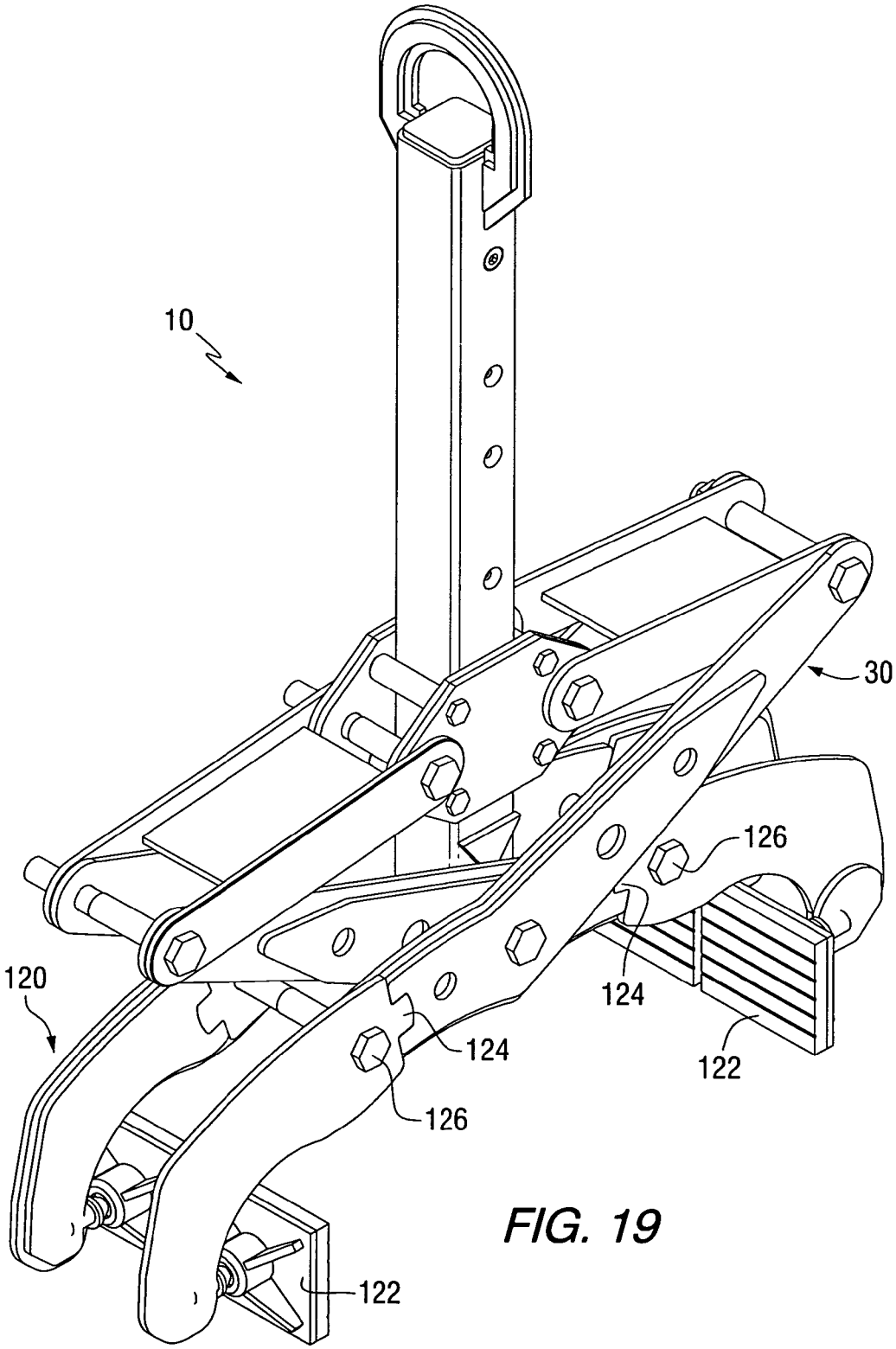
FIG. 19 is an isometric view of a tong lifting assembly and a clamp attachment in accordance with another embodiment of the present invention.
Figure 20:
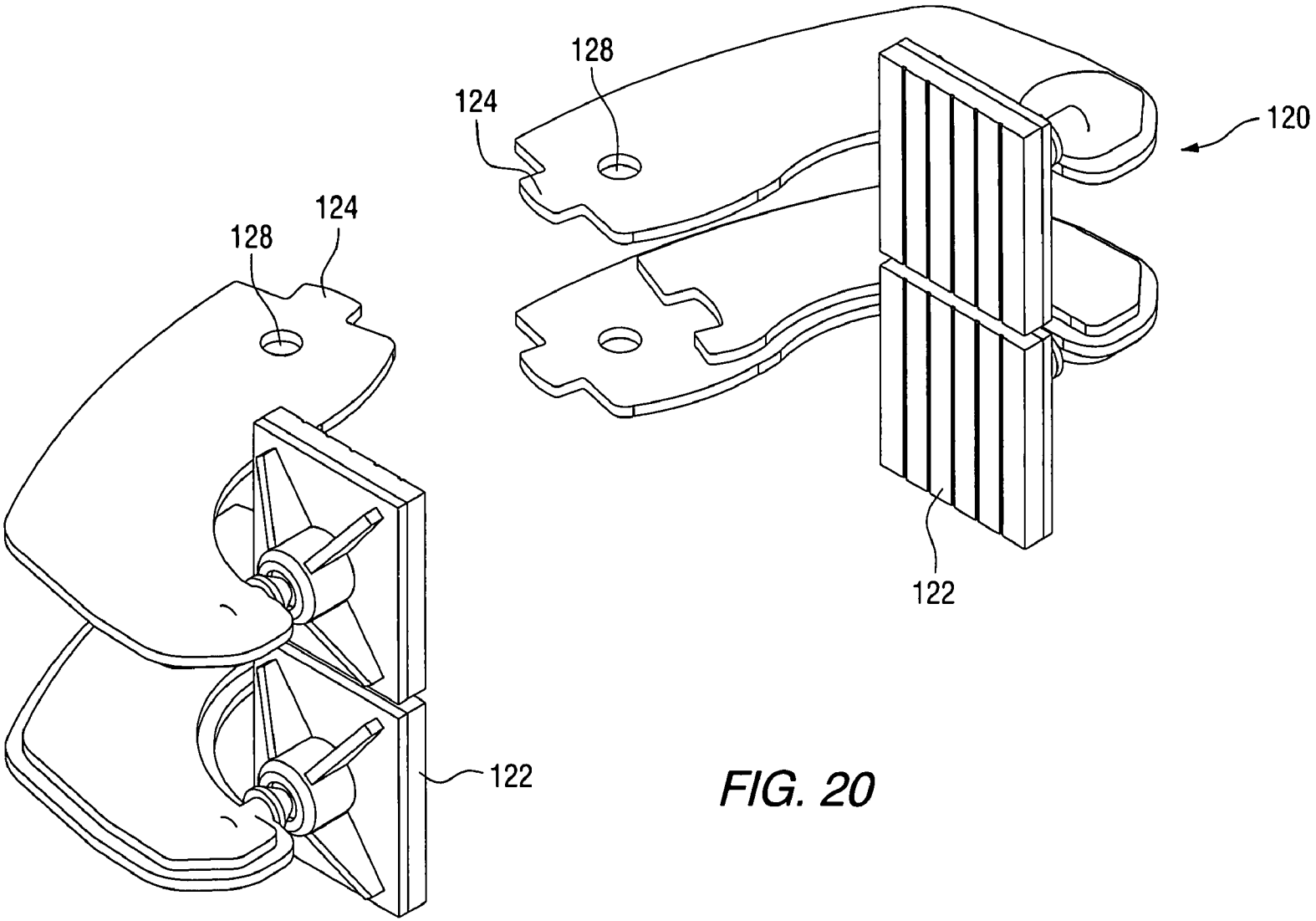
FIG. 20 is an isometric view of the clamp attachment of FIG. 19.

FIGS. 19 and 20 illustrate a tong lifting assembly 10 and a clamp attachment 120 in accordance with another embodiment of the present invention. The clamp attachment 120 includes clamps 122 with tabbed mounting ends 124. Mounting bolts 126 extend through mounting holes 128 near the mounting ends 124. The mounting bolts 126 also extend through the mounting holes 37*a* and 38*b* of the tongs 32*a* and 32*b*.

Figure 21:
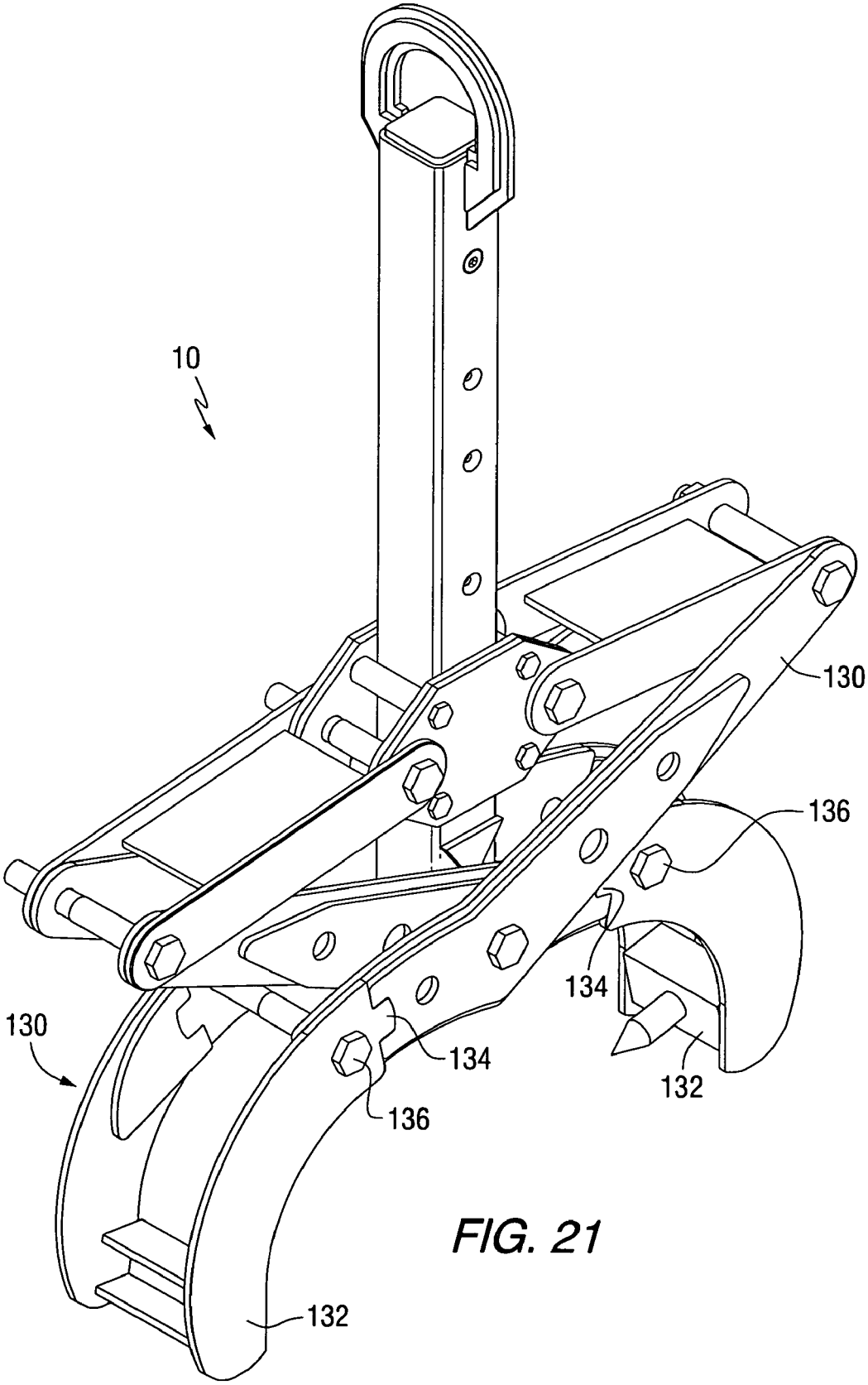
FIG. 21 is an isometric view of a tong lifting assembly and a spiked claw attachment in accordance with a further embodiment of the present invention.
Figure 22:
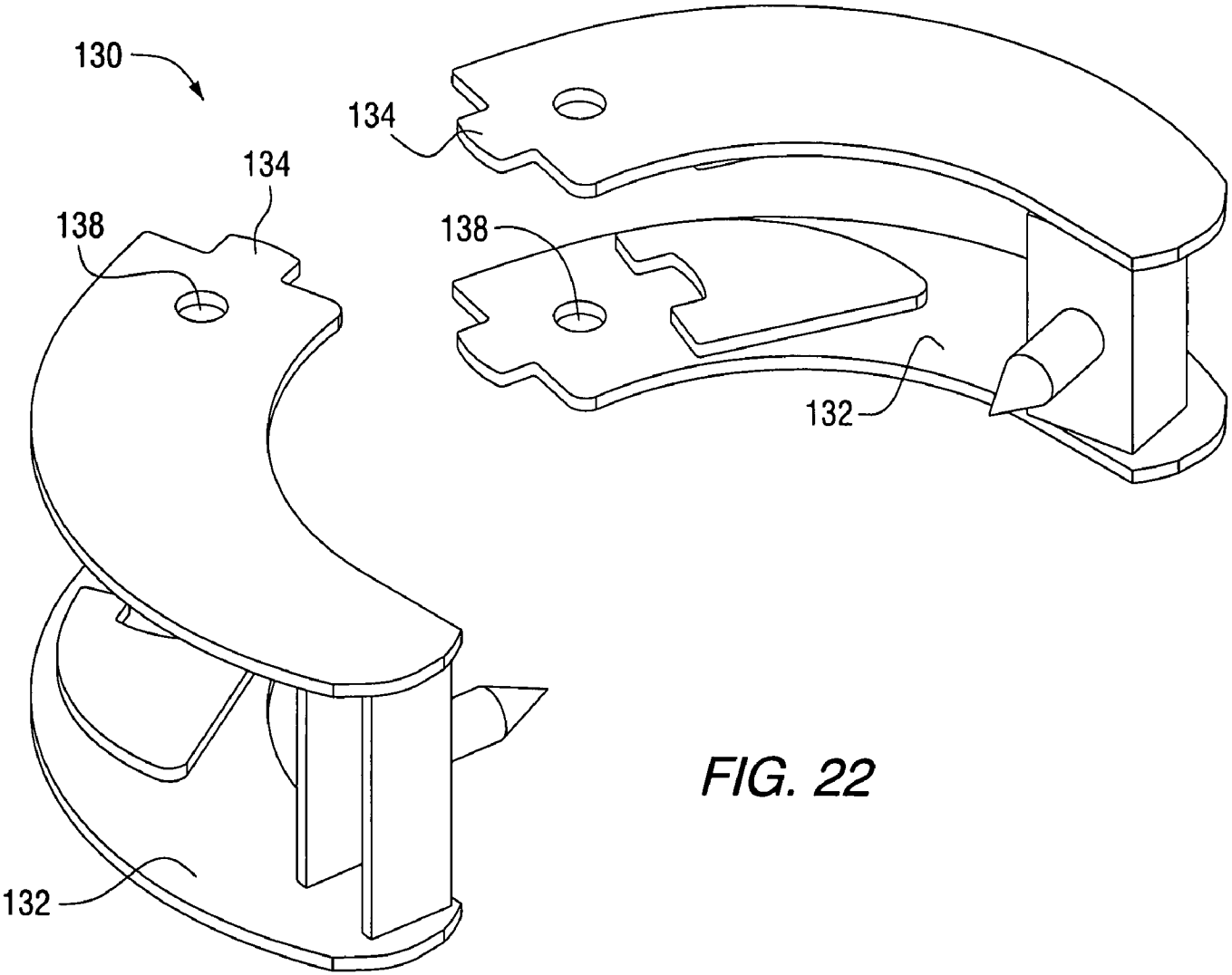
FIG. 22 is an isometric view of the spiked claw attachment of FIG. 21.

FIGS. 21 and 22 illustrate a tong lifting assembly 10 and a spiked claw attachment 130 in accordance with a further embodiment of the present invention. The spiked claw attachment 130 includes spiked claws 132 and tabbed mounting ends 134. Mounting bolts 136 extend through mounting holes 138 in the mounting ends 134. The mounting bolts 136 also extend through the mounting holes 37*a* and 37*b* of the tongs 32*a* and 32*b*.

Figure 23:
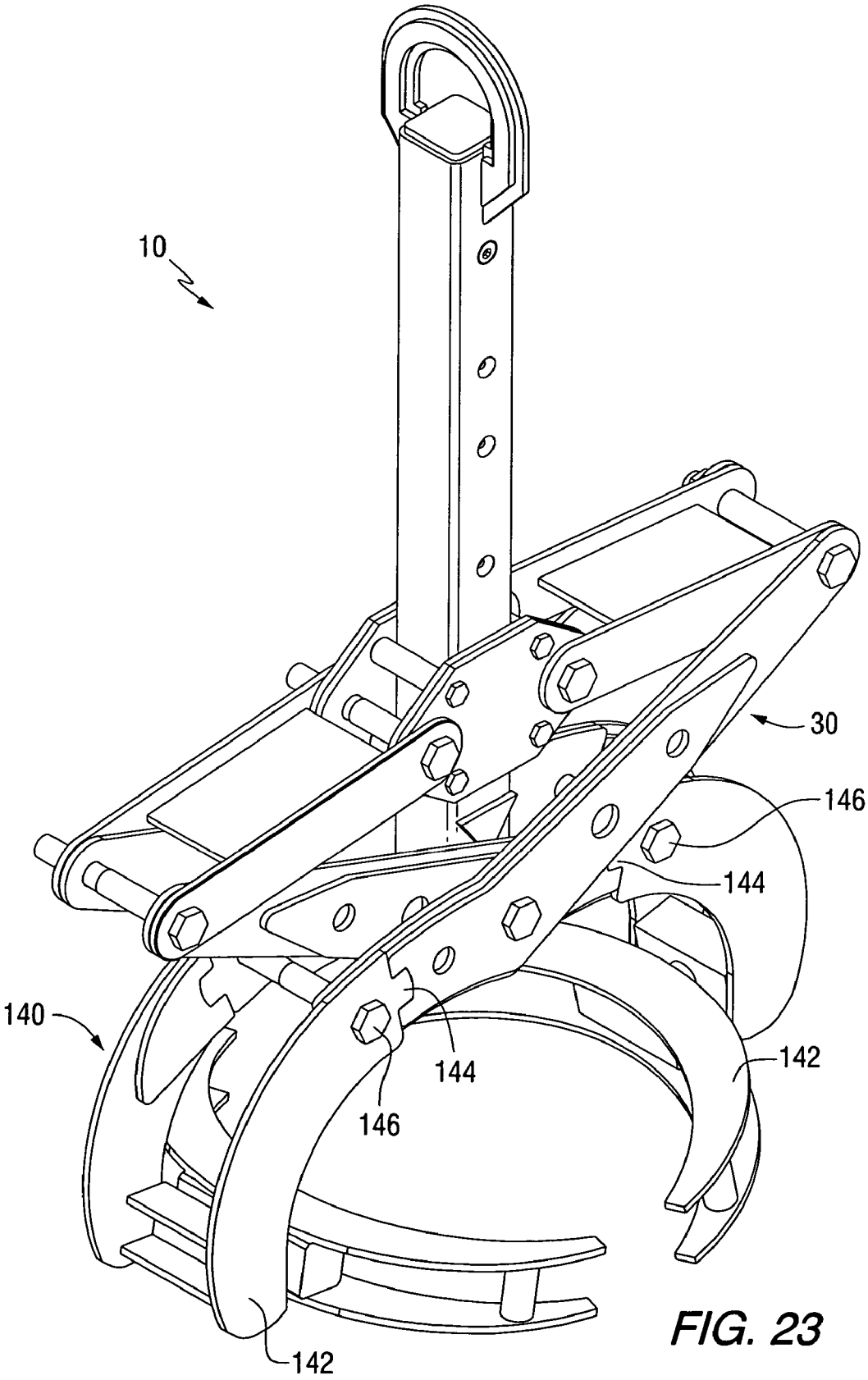
FIG. 23 is an isometric view of a tong lifting assembly and a vertical pipe lifting attachment in accordance with another embodiment of the present invention.
Figure 24:
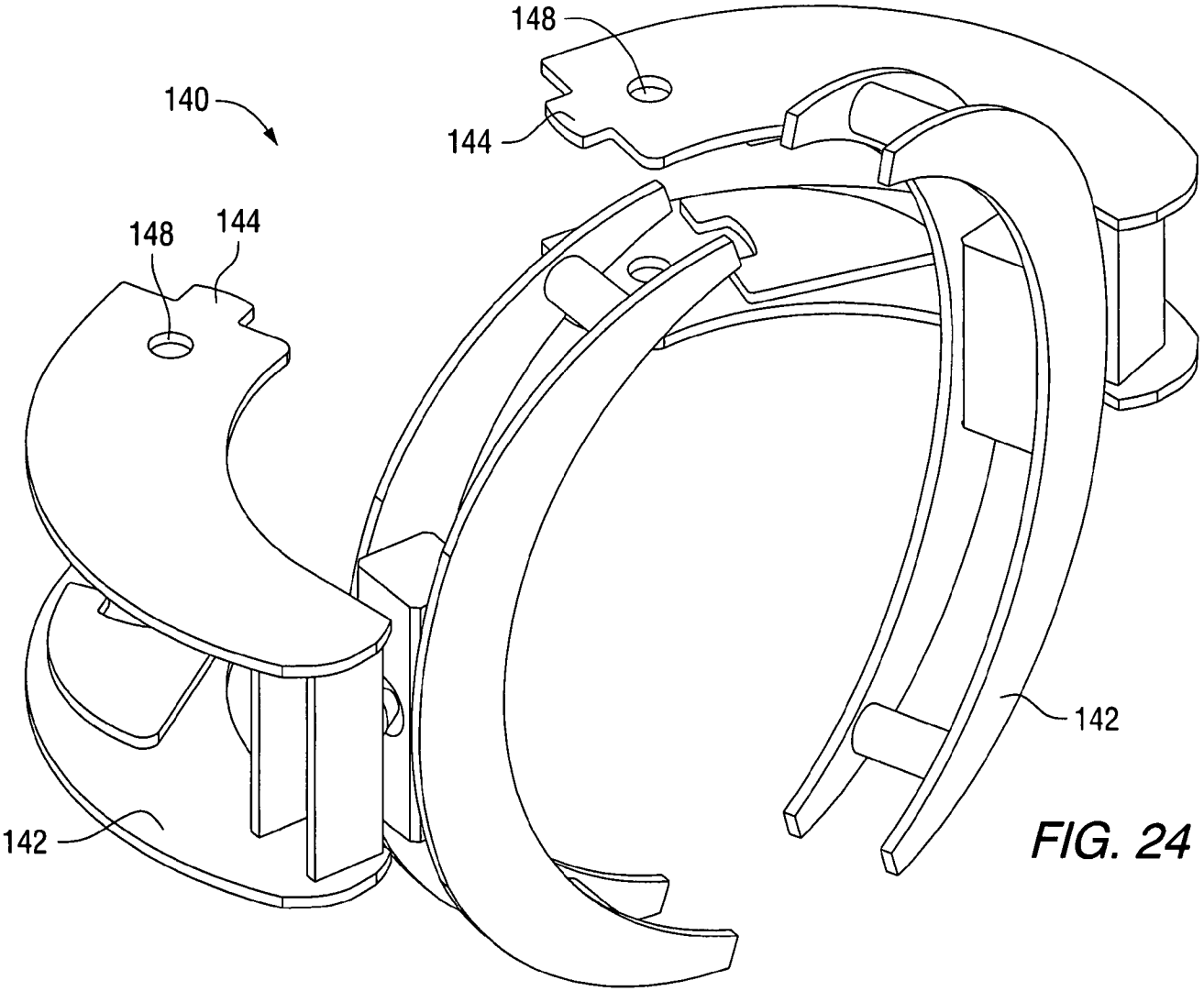
FIG. 24 is an isometric view of the vertical pipe lifting attachment of FIG. 23.

FIGS. 23 and 24 illustrate a tong lifting assembly 10 and a vertical pipe lifting attachment 140 in accordance with another embodiment of the present invention. The vertical pipe lifting attachment 140 includes claws 142 and tabbed mounting ends 144. Mounting bolts 146 extend through mounting holes 148 near the mounting ends 144. The mounting bolts 146 also extend through the mounting holes 37*a* and 37*b* of the tongs 32*a* and 32*b*.

Figure 25:
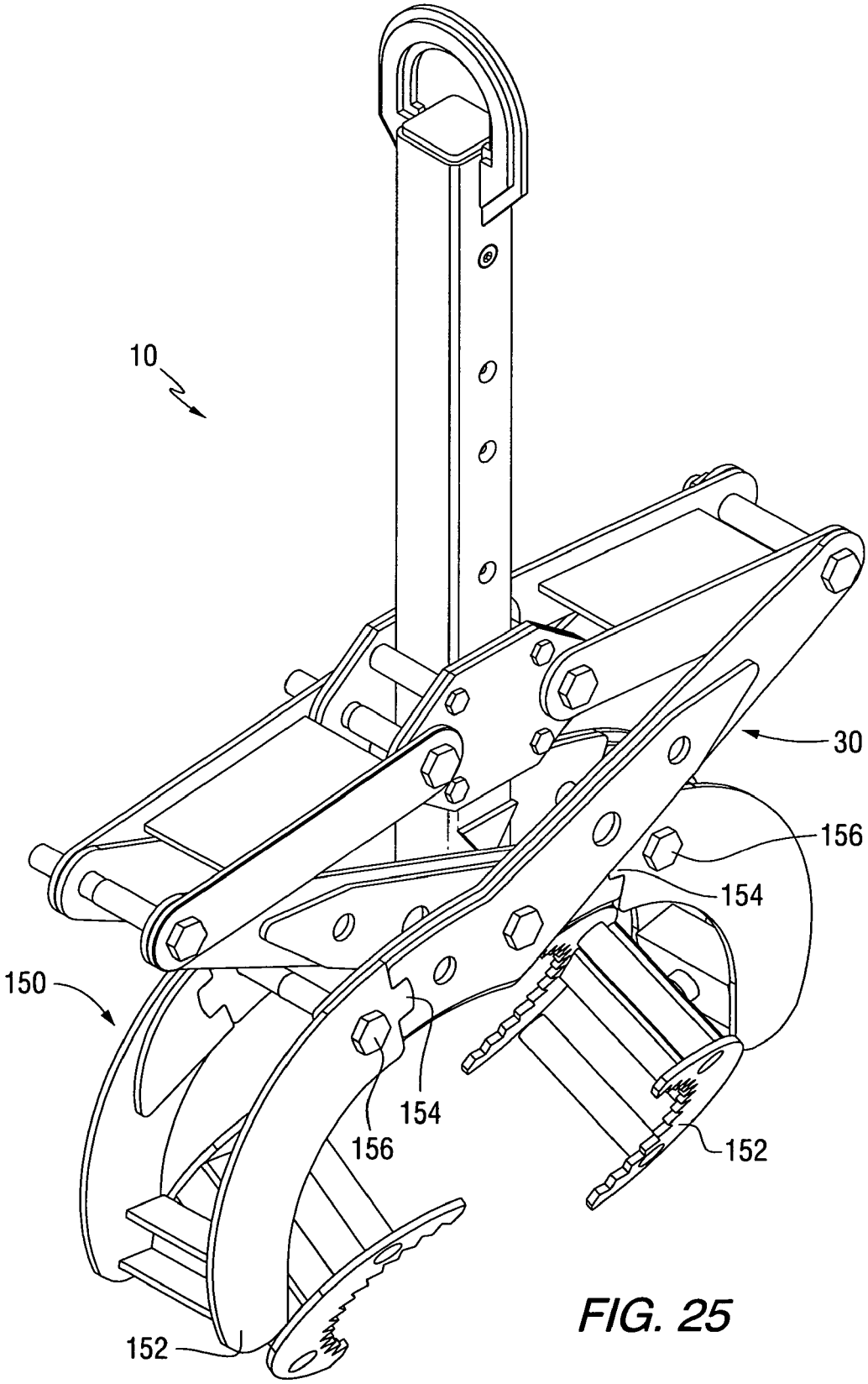
FIG. 25 is an isometric view of a tong lifting assembly and a rotatable claw attachment in accordance with a further embodiment of the present invention.
Figure 26:
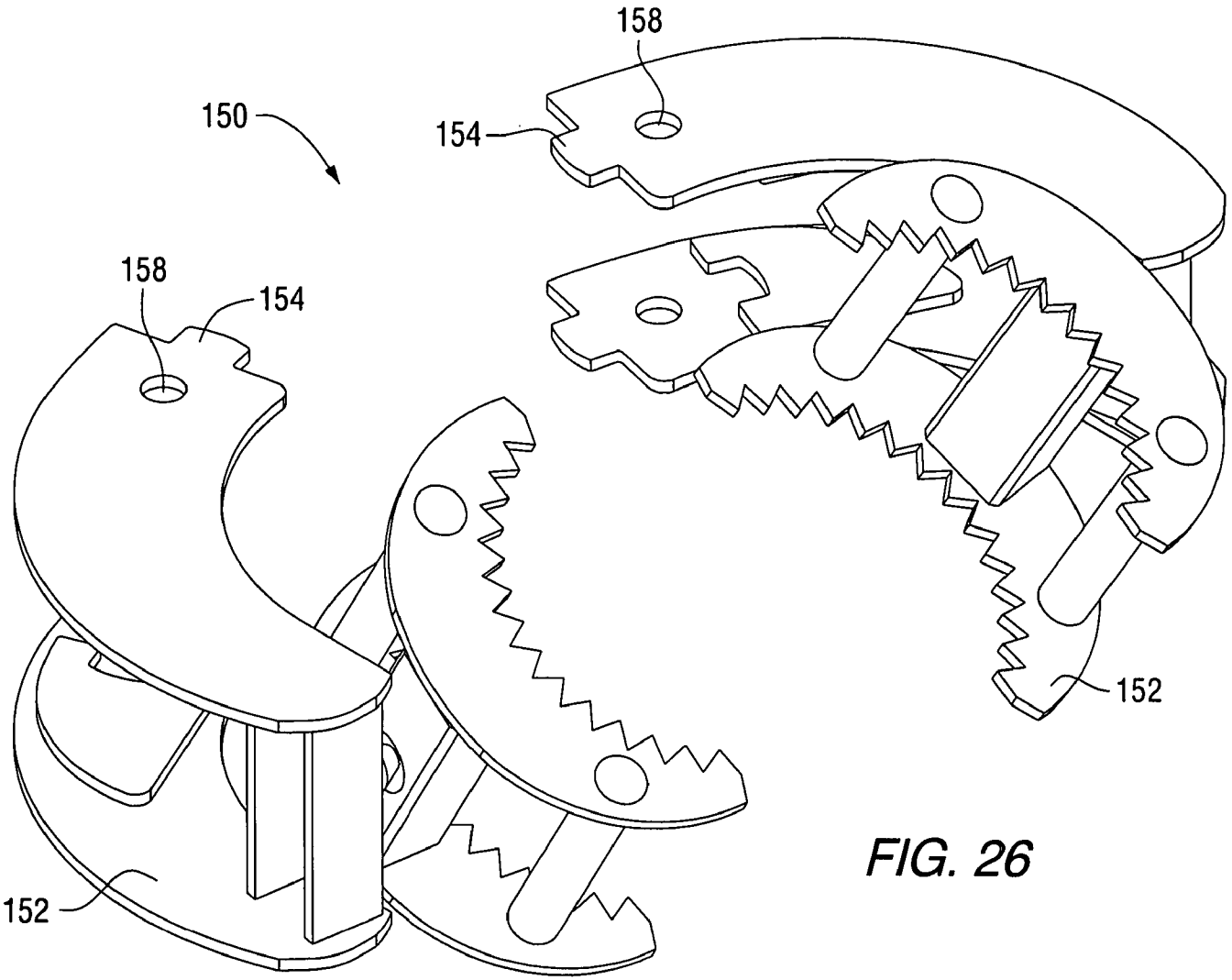
FIG. 26 is an isometric view of the rotatable claw attachment of FIG. 25.

FIGS. 25 and 26 illustrate a tong lifting assembly 10 and a rotatable claw attachment 150 in accordance with a further embodiment of the present invention. A rotatable claw attachment 150 includes rotatable claws 152 and tabbed mounting ends 154. Mounting bolts 156 extend through mounting holes 158 near the mounting ends 154. The mounting bolts 156 also extend through the mounting holes 37*a* and 37*b* of the tongs 32*a* and 32*b*.

In accordance with an embodiment of the present invention, with the addition of a center link added with certain attachments, the main tong pivot 34 is removed and the tongs 32*a* and 32*b* are pinned through the holes 37*a* and 37*b* used to fix the attachment to the tongs. An example of the use of a center link 85 is shown in FIGS. 13 and 14. Another example of the use of a center link 105 is shown in FIG. 18. The center link is placed inboard of the tongs on each side. This allows a greater gripping ratio at the expense of attachment travel. The keyed pattern 36*a* and 36*b* incorporated into the profile of the tongs 32*a* and 32*b*, and the tabs provided at the mounting ends of the attachment provides the transfer of force from the tongs to the attachments.

The tong lifting assembly of the present invention provides several advantages. The design allows for a self opening mode of lifter not present in existing designs. The sliding assembly provides the ability to latch the lifter in the open or release mode when the motion of the tines or other components of the attachment is restricted by the ground or adjacent objects. A mechanism by which to latch and unlatch the lifter cyclically is provided. The design allows multiple points of attachment of the latch assembly along the length of the lift sleeve to provide the ability to fix the open mode of the lifter to a given width for working in confined spaces. The design also allows the main points of geometry of the tongs to be field re-configured in order to accommodate loads of various profiles or shapes. The present device also allows field removal and replacement of a variety of load engaging tools to accommodate loads of various profiles or shape.

Whereas particular embodiments of this invention have been described above for purposes of illustration, it will be evident to those skilled in the art that numerous variations of the details of the present invention may be made without departing from the invention as defined in the appended claims.

The invention claimed is:

1. A tong lifting device comprising:

a lift sleeve;

a slide rod extendable from the lift sleeve;

at least two tongs pivotally mounted on the slide rod, each tong having an attachment end structured and arranged for mounting an attachment thereto and an arm extending away from the attachment end;

a sliding lobe assembly slidably mounted on the lift sleeve; and at least two linkages pivotally connected to the sliding lobe assembly, each linkage pivotally connected to the arm of one of the tongs.

2. The tong lifting device of claim 1, wherein the slide rod is receivable inside the lift sleeve.

3. The tong lifting device of claim 2, wherein the slide rod extends from a bottom end of the lift sleeve.

4. The tong lifting device of claim 1, further comprising a latch mounted on the slide rod which is engageable with a keeper mounted on the lift sleeve.

5. The tong lifting device of claim 1, comprising a latch mounted on the lift sleeve which is engageable with a keeper mounted on the slide rod.

6. The tong lifting device of claim 5, wherein the latch is selectively positionable along a length of the lift sleeve.

7. The tong lifting device of claim 1, wherein the attachment end of each tong comprises at least one tab receivable within a recess of the attachment.

8. The tong lifting device of claim 1, wherein each tong comprises a pivot hole between its attachment end and its arm for the pivotal mounting of the tong on the slide rod.

9. The tong lifting device of claim 8, wherein the pivot holes of the tongs are aligned with each other and a tong pivot pin extends through the tong pivot holes.

10. The tong lifting device of claim 9, wherein the tong pivot pin extends through a hole in a bottom end of the slide rod.

11. The tong lifting device of claim 1, further comprising a center link mounted on the slide rod with arms extending transversely away from a longitudinal direction of the slide rod, wherein the arms comprise means for providing the pivotal mounting of the tongs on the slide rod.

12. The tong lifting device of claim 11, wherein the means for providing the pivotal mounting of the tongs on the slide rod comprises:

a first tong pivot hole extending through one of the arms of the center link and a first tong pivot pin extending through the first tong pivot hole, wherein the first tong pivot pin extends through a hole in a first one of the tongs or through a hole in an attachment mounted on the first one of the tongs; and a second pivot hole extending through another one of the arms of the center link, and a second tong pivot pin extending through the second tong pivot hole, wherein the second tong pivot pin extends through a hole in a second one of the tongs or through a hole in an attachment mounted on the second one of the tongs.

13. The tong lifting device of claim 1, wherein the sliding lobe comprises opposing plates positioned on opposite sides of the lift sleeve.

14. The tong lifting device of claim 13, wherein the sliding lobe comprises:

a first hole receiving a first bolt which extends through a hole in a first one of the linkages to provide the pivotal connection between the first linkage and the sliding lobe; and a second hole receiving a second bolt which extends through a hole in a second one of the linkages to provide the pivotal connection between the second linkage and the sliding lobe.

15. The tong lifting device of claim 1, wherein the lift sleeve comprises at least one lift block for contacting and lifting the sliding lobe.

16. The tong lifting device of claim 1, wherein relative downward movement of the sliding lobe assembly with respect to the slide rod causes the tongs to open.

17. The tong lifting device of claim 1, further comprising an attachment mounted on the tongs.

18. An attachment structured and arranged for mounting on the tong lifting device of claim 1.

19. A tong lifting device and attachment assembly comprising:

a tong lifting device comprising:

a lift sleeve;

a slide rod extendable from a bottom end of the lift sleeve;

at least two tongs pivotally mounted on the slide rod, each tong having an attachment end structured and arranged for mounting an attachment thereto and an arm extending away from the attachment end;

a sliding lobe assembly slidably mounted on the lift sleeve; and at least two linkages pivotally connected to the sliding lobe assembly, each linkage pivotally connected to the arm of one of the tongs; and an attachment mounted on the tongs of the lifting device.

20. The tong lifting device and attachment assembly of claim 18, wherein the attachment is selected from a toothed claw attachment, a bucket attachment, a pipe lifting attachment, a clamp attachment, a spiked claw attachment, a vertical pipe lifting attachment, and a rotatable claw attachment.

* * * * *